US007216491B2

(12) United States Patent
Cole et al.

(10) Patent No.: US 7,216,491 B2
(45) Date of Patent: May 15, 2007

(54) ICE MAKER WITH ADAPTIVE FILL

(75) Inventors: Ronald E. Cole, Greenwood, IN (US); Laurence S. Slocum, Mooresville, IN (US); Dennis Tremblay, deceased, late of Geneva, IL (US); by Young Tremblay, legal representative, Geneva, IL (US)

(73) Assignee: Emerson Electric Co, St. Louis, MO (US)

( * ) Notice: Subject to any disclaimer, the term of this patent is extended or adjusted under 35 U.S.C. 154(b) by 115 days.

(21) Appl. No.: 11/119,073

(22) Filed: Apr. 29, 2005

(65) Prior Publication Data

US 2006/0242971 A1 Nov. 2, 2006

(51) Int. Cl.
*F25C 1/12* (2006.01)

(52) U.S. Cl. ..... 62/74; 62/188; 62/347

(58) Field of Classification Search ..... 62/188, 62/74, 347

See application file for complete search history.

(56) References Cited

U.S. PATENT DOCUMENTS 3,407,840 A * 10/1968 Finnegan ..... 137/392
4,429,550 A 2/1984 Latter
4,727,720 A 3/1988 Wernicki
4,923,494 A 5/1990 Karlovits
5,129,237 A 7/1992 Day et al.
5,619,858 A 4/1997 Gunderson et al.
5,992,167 A * 11/1999 Hill et al. ..... 62/188
6,067,806 A 5/2000 Park
6,092,374 A 7/2000 Kang et al.
6,574,974 B1 * 6/2003 Herzog et al. ..... 62/135
6,978,626 B2 * 12/2005 Kim et al. ..... 62/74
2001/0039804 A1 11/2001 Newman et al.
2003/0010053 A1 1/2003 Kim et al.

* cited by examiner

*Primary Examiner*—William E. Tapolcai
(74) *Attorney, Agent, or Firm*—Maginot, Moore & Beck

(57) ABSTRACT

An icemaker assembly includes an ice tray having an ice forming compartment, a water line configured to advance water from a water source to the ice tray, a valve operable to selectively block advancement of water through the water line while an actuation signal is generated, a control system operable to generate the actuation signal for a water advancement period, a water level detection system for determining if a level of water in the ice forming compartment is below a threshold value and generating a control signal in response thereto. The control system is further operable to alter a magnitude of the water advancement period in response to generation of the control signal. Water is initially advanced into the ice forming compartment for a first period of time during a first ice making cycle by opening the valve. If it is determined that the level of water in the ice forming compartment is below a threshold value during the first ice making cycle, a control signal is generated in response thereto and during a second ice making period the valve is opened for a second period of time in response to generation of the control signal so that water advances into the ice forming compartment of said ice tray through the valve during said second ice making cycle for a period of time that is greater than the first period of time.

13 Claims, 18 Drawing Sheets

ICE MAKER WITH ADAPTIVE FILL

CROSS REFERENCE

Cross reference is made to co-pending U.S. patent application Ser. No. 10/895,665 filed Jul. 21, 2004, entitled Method and Device for Stirring Water During Icemaking, U.S. patent application Ser. No. 10/895,792 filed Jul. 21, 2004, entitled Method and Device for Eliminating Connecting Webs Between Ice Cubes and U.S. patent application Ser. No. 10/895,570 filed Jul. 21, 2004, entitled Method and Device for Producing Ice Having a Harvest-facilitating Shape, which are assigned to the same assignee as the present invention, the disclosures of which are hereby incorporated by reference in their entirety.

BACKGROUND AND SUMMARY

This invention relates to icemakers for household refrigerators and more particularly to ice makers that adjust the fill time based upon a sensed level of filling of the ice tray.

Conventional ice makers typically provide an ice tray including a plurality of compartments to be filled with water which is frozen to form ice cubes. A water supply is typically in fluid communication with at least one of the compartments of the ice tray. Often weirs, slots or gaps are provided between adjacent compartments in the tray so that water may be introduced into one compartment and overflow into adjacent compartments.

Typically ice makers use a timer controlled valve on the water supply to determine the level of water in the compartments. This method of controlling water level requires an initial calibration of the device to achieve the desired fill level. Often the fill level may be adjusted by the user between a minimum level wherein the valve is open for a minimum time interval and a maximum level wherein the valve is open for a maximum time interval.

In some prior art devices, the timer is implemented on a disk attached to the end of a motor driven shaft of an ejector arm that rotates at a known rate. In such implementations, during an ejection cycle when the ejector arm is being rotated 360 degrees to eject the ice cubes, a contact engages a conductive strip on the disk after the ejector arm has rotated sufficiently to eject ice formed in the compartments of the tray thereby closing a circuit that opens the solenoid operated water valve. The conductive strip extends about the focus of the disk and has a length. However, the conductive strip is either non-concentrically located or varies in width so that lateral movement of the contact can cause the contact to engage and disengage the conductive strip at various points during rotation of the ejector arm. Thus, by adjusting the lateral position of the first contact, the user can control the time that the water fill valve is opened and thus adjust the level of the water in the compartments.

Unfortunately, timers alone cannot guaranty consistent fill levels. Over time, water lines tend to become corroded or clogged with mineral deposits. Additionally, water pressure may vary. These factors alter the flow rate of water into the compartments and thus the fill level of the compartments. An increase in flow rate could result in an overflow of the ice-tray allowing water to flow into the freezer compartment. A decrease in flow rate could result in smaller ice cubes and insufficient ice supply.

Thus, an ice maker that adapts to differing flow rates to maintain the fill level of the ice forming compartments would be appreciated.

According to one aspect of the disclosure, a method of producing ice comprises the steps of opening a valve for a first period of time, determining if a level of water is below a threshold value, opening the valve for a second period of time. The opening a valve for a first period of time step occurs during a first ice making cycle so that water advances from a fluid source into at least one ice forming compartment of an ice tray through the valve. The determining if a level of water is below a threshold value step occurs in at least one ice forming compartment during the first ice making cycle. A control signal is generated in response to the determining step. The opening the valve for a second period of time occurs during a second ice making cycle in response to generation of the control signal so that water advances from a fluid source into the at least one ice forming compartment of the ice tray through the valve during the second ice making cycle. The second period of time is greater than the first period of time.

According to a second aspect of the disclosure, a method of producing ice, comprises the steps of performing successive ice making cycles, determining if a size characteristic of said ice member produced during a first ice making cycle is less than a threshold value and generating a control signal in response thereto and increasing a magnitude of said water advancement period for a subsequent ice making cycle in response to generation of said control signal. Each ice making cycle includes advancing water into at least one ice forming compartment of an ice tray by opening a valve connected to a water source for a water advancement period and reducing the temperature of water within said ice tray after said water advancing step so as to cause said water located within said at least one ice forming compartment to become an ice member.

According to yet another aspect of the disclosure, an icemaker assembly comprises an ice tray, a water line, a valve, a control system, and a water level detection system. The ice tray has at least one ice forming compartment. The water line is configured to advance water from a water source to the ice tray. The valve is operable to selectively block advancement of water through the water line while an actuation signal is generated. The control system is operable to generate the actuation signal for a water advancement period. The water level detection system determines if a level of water in the at least one ice forming compartment is below a threshold value and generates a control signal in response thereto. The control system is further operable to increase a magnitude of the water advancement period in response to generation of the control signal.

According to still another aspect of the disclosure, an icemaker assembly comprises an ice tray, a water line, a valve, a control system and an ice size detector. The ice tray has at least one ice forming compartment. The water line is configured to advance water from a water source to the ice tray. The valve is operable to selectively block advancement of water through the water line while an actuation signal is generated. The control system is operable to generate the actuation signal for a water advancement period. The ice size detection system determines if a size characteristic of an ice member located in the at least one ice forming compartment is less than a threshold value and generates a control signal in response thereto. The control system is further operable to increase a magnitude of said water advancement period in response to generation of the control signal.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The illustrative devices will be described hereinafter with reference to the attached drawings which are given as non-limiting examples only, in which.

Corresponding reference characters indicate corresponding parts throughout the several views. Like reference characters tend to indicate like parts throughout the several views.

DETAILED DESCRIPTION

Figure 1:
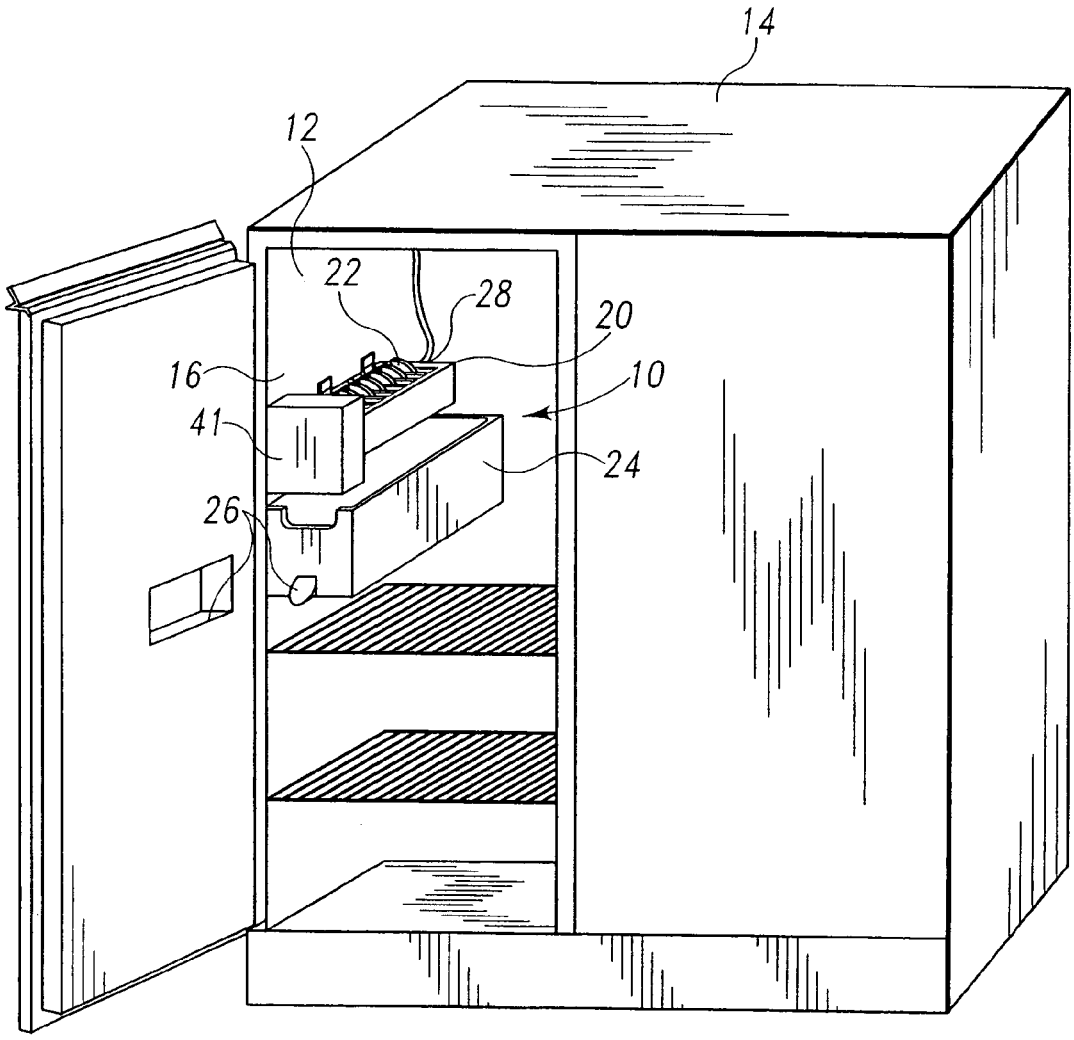
FIG. 1 is a perspective view of an icemaker mounted to the inside of a freezer compartment of a household side-by-side refrigerator/freezer showing an icemaker assembly including an ice tray, an ejector arm and a control box wherein a motor is mounted, a water inlet, and an ice bin.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one skilled in the art to which this invention pertains.

As shown, for example, in FIGS. 1–7, an ice maker assembly 10 is incorporated in a freezer compartment 12 of a household side by side refrigerator/freezer 14. The icemaker assembly 10 is mounted to a side wall 16 of the freezer compartment 12. The illustrated refrigerator/freezer 14 includes through the door ice and water. To facilitate through the door delivery of ice, the illustrated ice maker assembly 10 includes an ice tray 20, an ice ejector 22, an ice bin 24, an ice dispenser 26, a water inlet 28 and a controller 30. In the illustrated ice maker assembly 10, the water inlet or line 28 is in fluid communication with ice tray 20 and a household water supply 18 so that water may be added to ice tray 20. A solenoid actuated water valve 32 is disposed in the line 28 between the household water supply 18 and the tray 20 to control the flow of water into the tray 20. Water received in tray 20 freezes and is removed from tray 20 by ejector 22. Ice ejected from tray 20 is received in bin 24 where it is stored awaiting use. The bin 24 is formed to include a dispenser 26 from which ice is dispensed to the user. In the illustrated embodiment of ice maker assembly 10 dispenser 26 is a through the door ice dispenser.

Referring now to FIGS. 2–7, the icemaker assembly 10 is shown removed from the freezer compartment 12 and in various states of disassembly. In the illustrated embodiment, ice tray 20 includes a plurality of compartments 66 within which ice is formed. A first compartment **66*r* is positioned adjacent to the outlet of the water line 28 and is in fluid communication with the outlet. The illustrated tray 20 is designed for overflow filling, i.e. water fills the rear compartment 66*r* to the point of overflowing and the overflow water then fills the adjacent compartment 66**.

Figure 3:
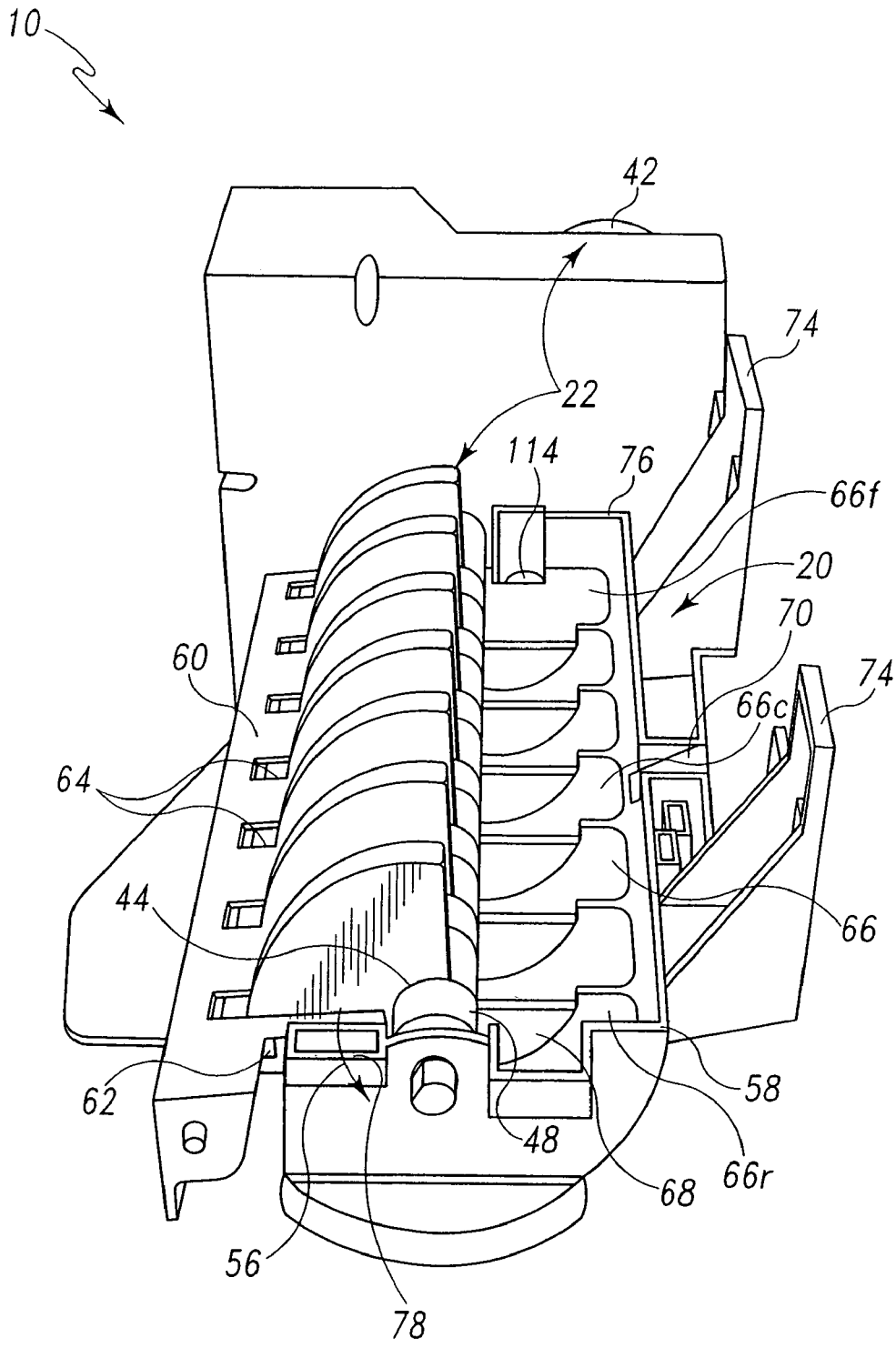
FIG. 3 is a perspective view of the ice tray and ejector arm of the icemaker of FIG. 2.
Figure 4:
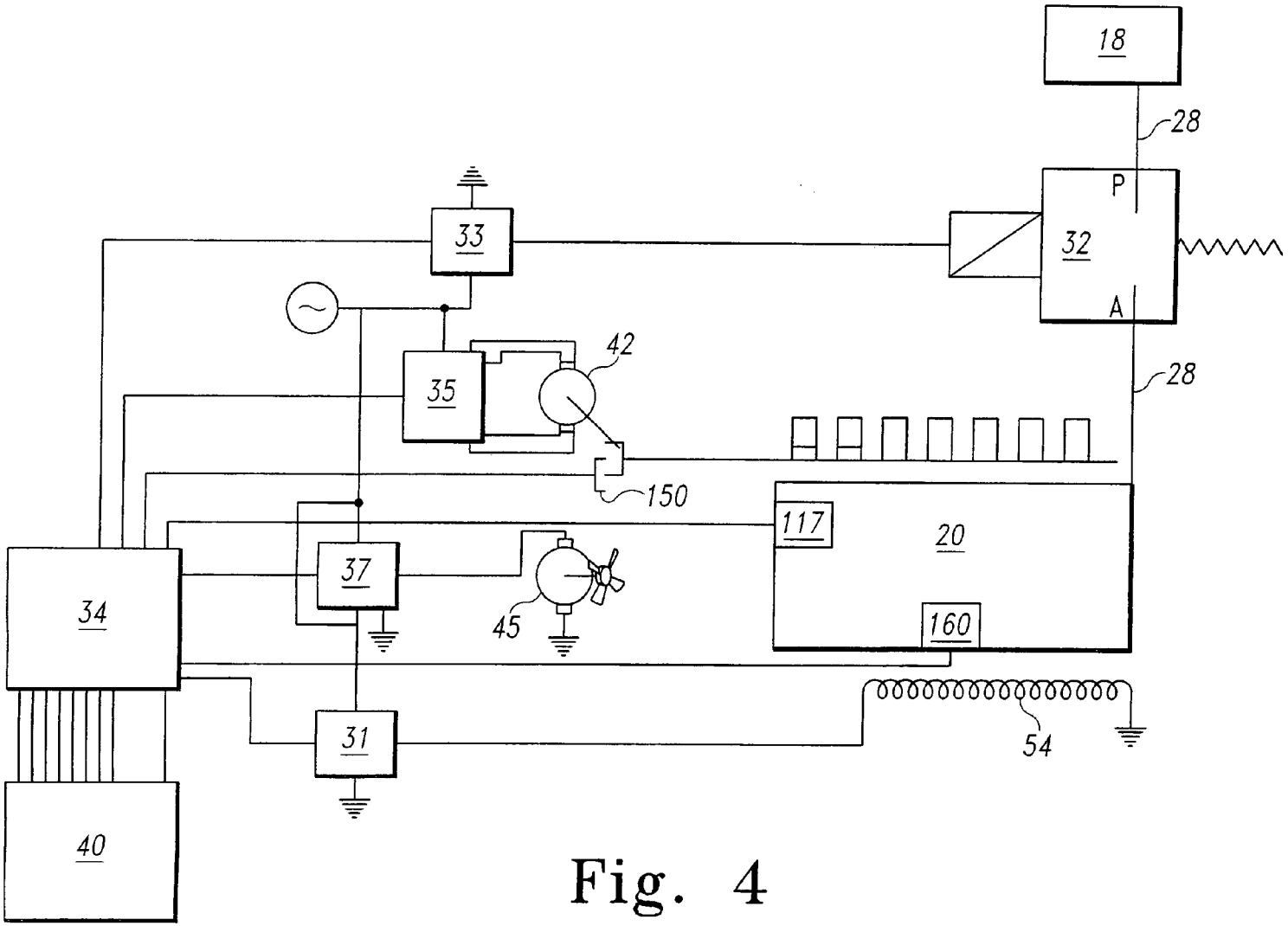
FIG. 4 is a block diagram of the controller and systems of the disclosed ice maker assembly.
Figure 5:
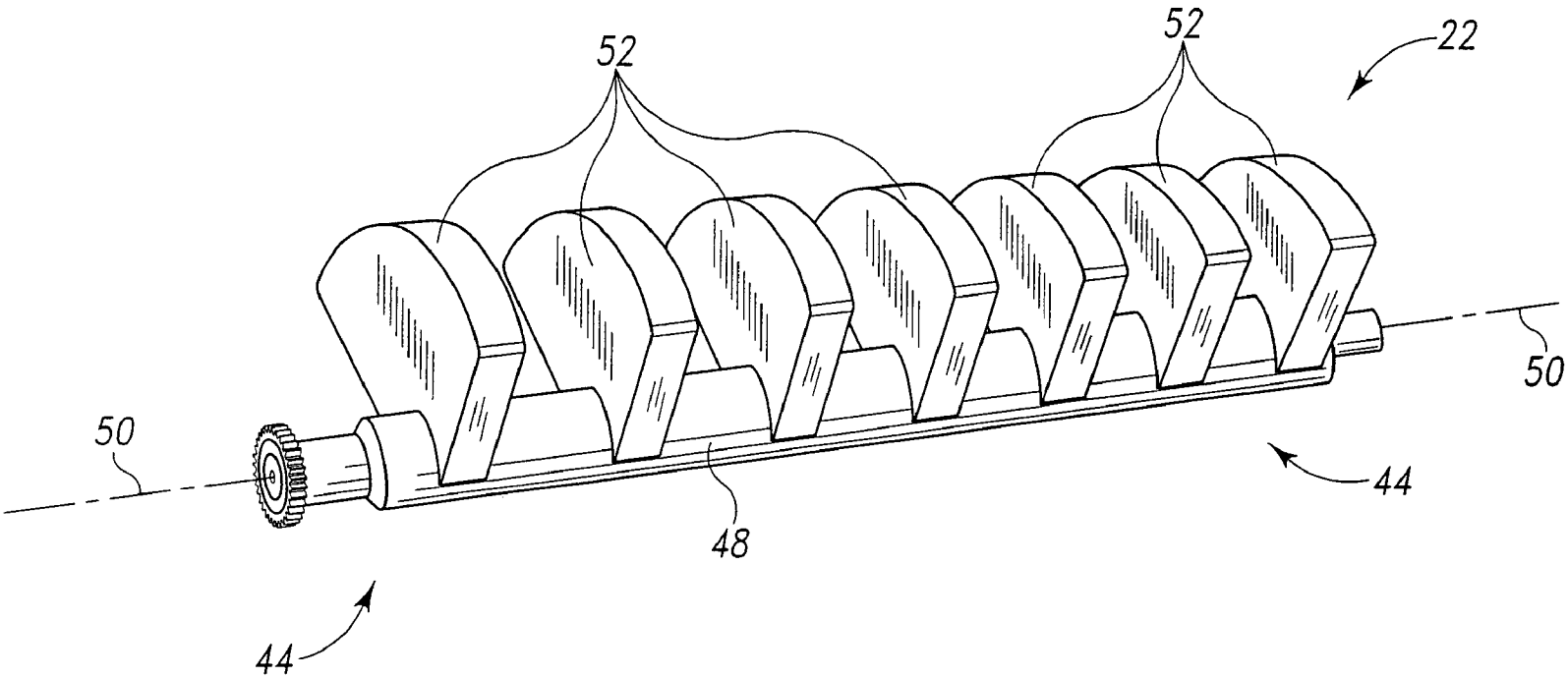
FIG. 5 is a perspective view of the ejector arm of the ice maker assembly of FIG. 2 showing seven ejector members mounted to a shaft configured to be rotated by the motor.
Figure 7:
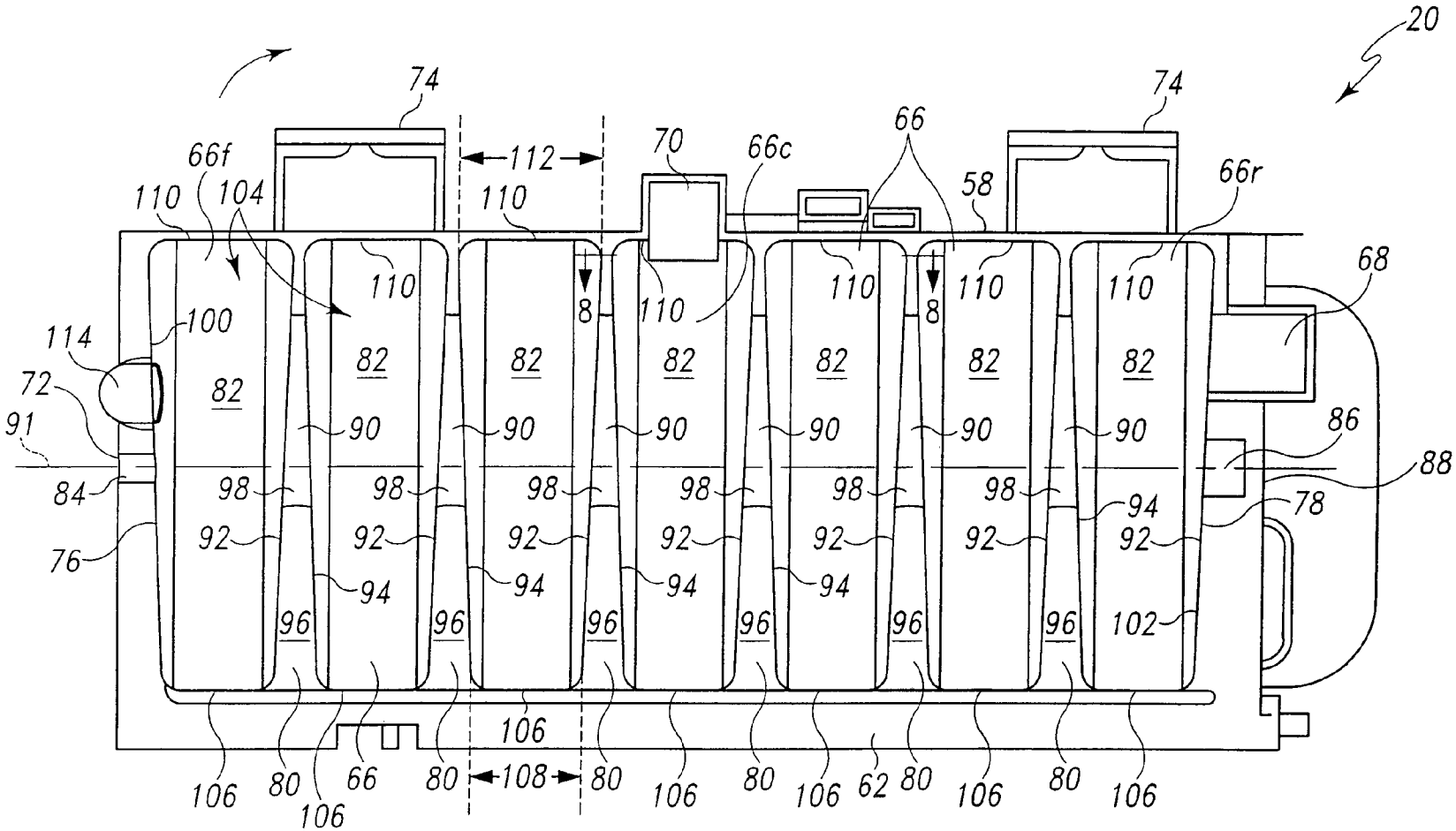
FIG. 7 is a plan view of the ice tray of FIG. 3 showing the configuration of the divider walls between adjacent crescent-shaped compartments.

As shown, for example, in FIGS. 3 and 7, ice tray 20 is formed to include seven tapered crescent-shaped compartments 66, an end water inlet ramp 68, a side water inlet ramp 70, ejector arm mounting features 72, and mounting brackets 74. Tray 20 includes a first end wall 76, a second end wall 78, a plurality of partitions or divider walls 80 and a plurality of floor walls 82 that cooperate to form the ice forming compartments 66. In the illustrated embodiment, the end water inlet ramp 68 is formed in the second end wall 78 to be positioned below the water inlet 28 to facilitate filling the seven compartments 66 using the overflow method. The side water inlet ramp 70 is provided for those refrigerator/freezers 14 that position the water inlet along the mounting wall 16 of the freezer compartment 12. Water inlet ramps communicating with an ice forming compartment 66 may be formed in other locations on the tray within the scope of the disclosure.

The ejector mounting arm features 72 include a shaft-receiving semi-cylindrical bearing surface 84 formed in the first end wall 76, a shaft-receiving semi-cylindrical bearing surface 86 formed in the second end wall 78, a shaft-receiving aperture 88 formed through the second end wall 78, and portions of each of a plurality of overflow channels 90 formed in each divider wall 80. The shaft-receiving semi-cylindrical bearing surfaces 84, 86 and the shaft-receiving aperture 88 are formed concentrically about the rotation axis 91 of the shaft 48 of the ejector arm 44. The shaft-receiving semi-cylindrical bearing surfaces 84, 86, the shaft-receiving aperture 88 and the portions of the overflow channels 90 are sized to receive the shaft 48 of the ejector arm 44 for free rotation therein. The shaft-receiving semi-cylindrical bearing surfaces 84, 86, the shaft-receiving aperture 88 and the portions of the overflow channels 90 are positioned to permit the longitudinal axis 50 of the shaft 48 of the ejector arm 44 to coincide with the rotation axis 91 when the ejector arm 44 is received in the tray 20 and rotated by the motor 42 and drive train 46.

As mentioned above, each partition or divider wall 80 extends laterally, relative to longitudinal axis 50, across the ice tray 20. In the illustrated embodiment, each divider wall 80 includes a forwardly facing lateral side surface 92, a rearwardly facing lateral side surface 94 and a top surface 96. The forwardly facing lateral side surface 92, rearwardly facing lateral side surface 94 and top surface 96 are formed to include an overflow channel 90. Each overflow channel 90 includes a top wall 98 positioned below the top surface 96 of the divider wall 80. The top wall 98 of the overflow channel 90 is positioned near the desired maximum fill level of each compartment 66. The first end wall 76 includes a rearwardly facing lateral side surface 100. The second end wall 78 includes a forwardly facing lateral side surface 102.

Figure 6:
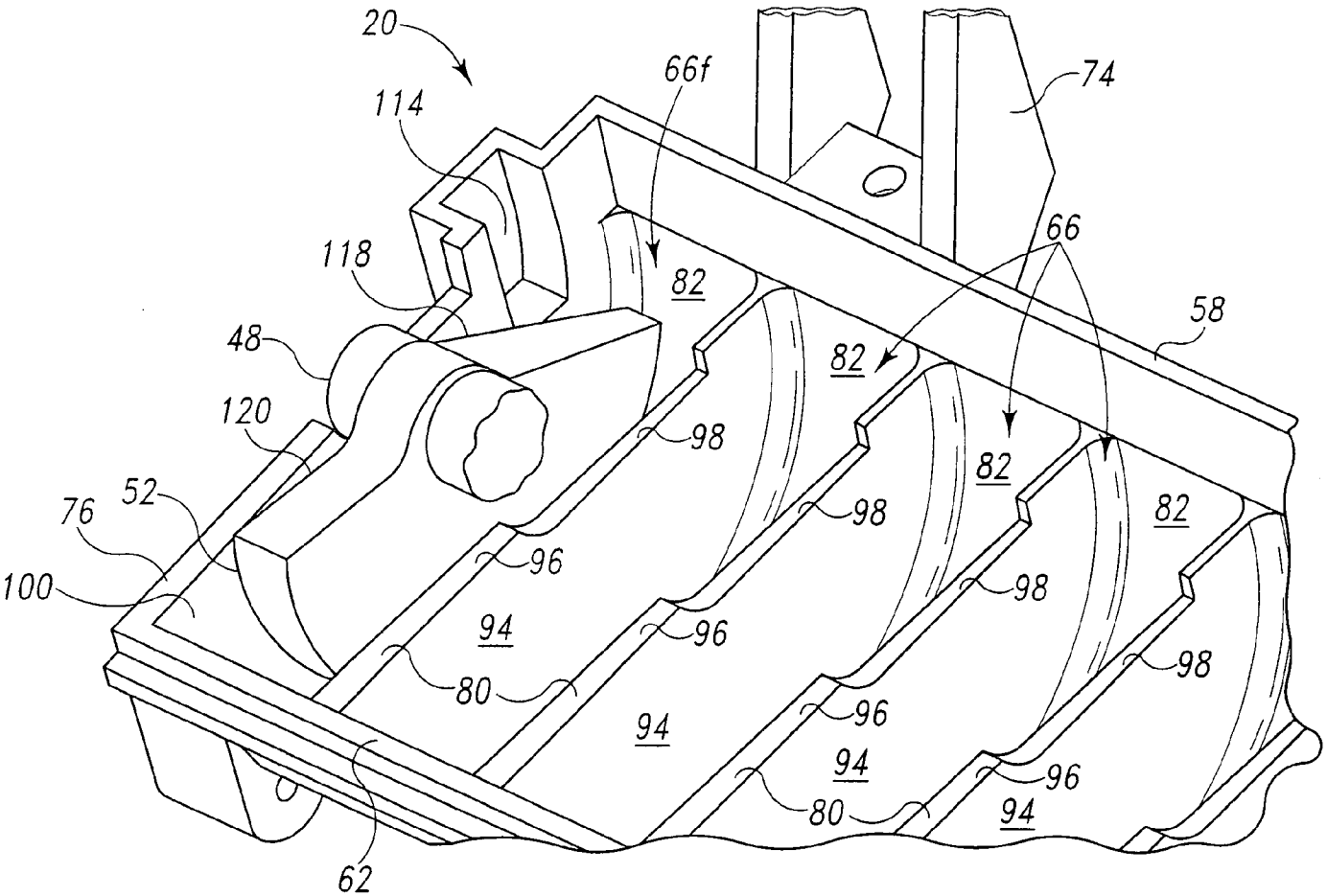
FIG. 6 is a perspective view of the front portion of the ice tray and ejector arm of FIG. 3 with parts broken away showing the overflow channels in divider walls between each adjacent crescent-shaped compartment and a displacement member disposed in the front compartment to facilitate overflow filling of the ice tray.

As shown, for example, in FIGS. 6 and 7, each compartment 66 of ice tray 20 is configured to include a space 104 in which a tapered crescent-shaped ice cube 130 is formed. In each compartment 66, one planar lateral side surface 100, 94, from an end wall 76 or a divider wall 80, respectively, is positioned relative to a second planar lateral side surface 92, 102, from an adjacent divider wall 80 or end wall 78, respectively, so that the first planar lateral side surface 100, 94 is spaced apart from the second planar lateral side surface 92, 102 at a downstream or narrow end 106 by a distance D1 108 relative to an ejection path of movement or harvest direction. In each compartment 66, the first planar lateral side surface 100, 94 is spaced apart from the second planar lateral side surface 92, 102 at an upstream or wide end 110 of the compartment 66 by a distance D2 112 relative to said ejection path of movement. In the illustrated embodiment, the upstream end 110 of the compartment 66 is the end of the compartment 66 adjacent the ejection side 58 of the tray 20. As shown, for example, in FIG. 7, the distance D2 112 is greater than the distance D1 108.

Figure 8:
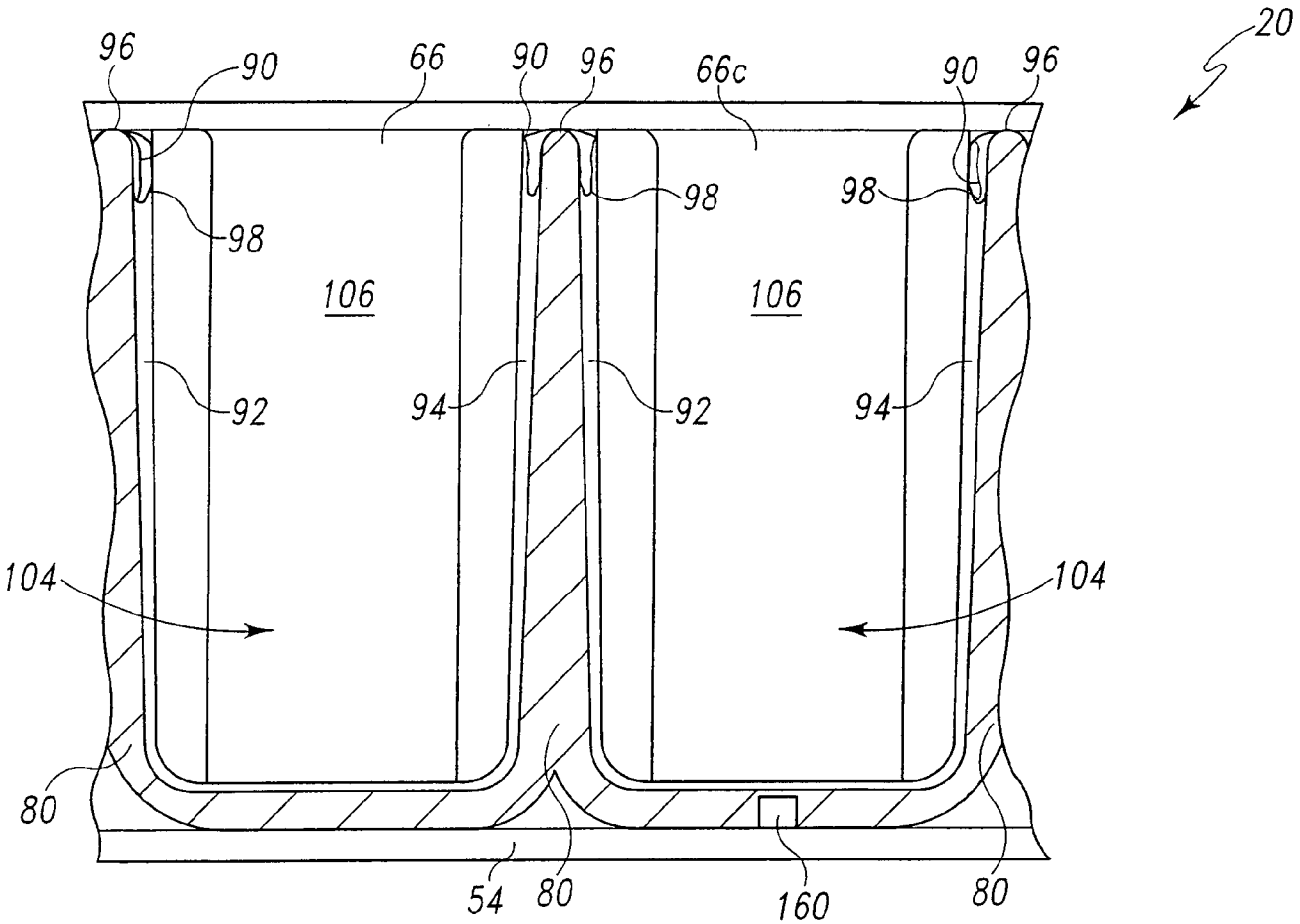
FIG. 8 is a sectional view of the ice tray taken along line 8—8 of FIG. 7 which also shows a heater disposed below the ice tray.

In the illustrated embodiment, each lateral side surface 92, 94, 100, 102 is planar, except for a bottom portion that smoothly curves into the bottom surface 82 to facilitate formation of the ice tray 20 using a molding process. As in prior art ice trays, the width of the compartment 66 may be narrower near the bottom and wider near the top, as shown, for example, in FIG. 8, to facilitate formation of the ice tray 20 using a molding process. The disclosed ice tray 20 forms tapered crescent-shaped ice cubes 130 which facilitate harvesting of the ice cubes by reducing heating of the tray 20 prior to ejection. Such an ice tray 20 is more particularly described in U.S. patent application Ser. No. 10/895,570, filed Jul. 21, 2004, entitled Method and Device for Producing Ice Having a Harvest-facilitating Shape, which is assigned to the same assignee as the present invention, the disclosure of which is hereby incorporated by reference in its entirety.

The ice ejector 22 includes a motor 42 having an output shaft, the ejector arm 44 and a drive train 46 coupling the output shaft of the motor 42 to the ejector arm 44. Rotation of the output shaft of the motor 42 is transferred through the drive train 46 to induce rotation of the ejector arm 44 about its longitudinal axis 50. As shown, for example, in FIGS. 3, 5, 6 and 9–15, the ejector arm 44 includes a shaft 48 formed concentrically about its longitudinal axis 50 and a plurality of ejector members 52 connected to and extending radially beyond the shaft 48. In the illustrated embodiment, the ejector members 52 are crescent-shaped fins and are configured to extend from the shaft 48 into the ice tray 20 when the shaft 48 is rotated. The disclosed ejector members 52 are utilized to eject ice cubes 130 from the tray 20 and may be utilized to displace water in the compartments 66, stir water in the compartments 66 or determine the size of the ice cubes 130 formed in the compartments 66.

As shown, for example, in FIGS. 6 and 9–15, each ejector member 52 includes a front face 118 and a rear face 120. Each ejector member 52 also includes a first side wall, a second side wall and an outer wall 126 each extending between the front face 118 and the rear face 120. In the illustrated embodiment, front face 118 and rear face 120 are each planar and are angularly displaced from each other by an angle 128. In the illustrated embodiment, the angle between front face 118 and rear face 120 is approximately one hundred ninety-five degrees. Those skilled in the art will recognize that angle 128 is not critical and can assume other values.

Outer wall 126 is formed about a radius 129. Radius 129 is sufficient for a portion of the outer wall 126, when ejector arm 44 is properly oriented and mounted to rotate about rotation axis 91, to extend into the ice forming space 104 of a compartment 66 and be positioned vertically below the top wall 98 of the overflow channel 90 of the compartment 66 of ice tray 20. Illustratively, radius 129 is sufficient to place outer wall 126 over half way between the shaft 48 and the bottom wall 82 of the compartment 66 without engaging the bottom wall 82 of the compartment, as shown, for example, in FIG. 9, when the ejector arm 44 is mounted for rotation about rotation axis 91.

Those skilled in the art will recognize that ejector members 52 may assume other configurations than those described above and still serve the purpose of acting as an ejector member 52, a displacement member, a stirrer and an ice height detector arm. It is within the scope of the disclosure for ejector members 52 to be fingers, shafts or other structures extending radially beyond the outer walls of shaft 48.

An ice guiding cover 60 extends inwardly from the outside 62 of the tray 20 and is configured to include slide fingers with slots 64 formed therebetween to permit the ejector members 52 of the ejector arm 44 to extend through slots 64 in the cover 60 into the ice tray 20. Ice cubes ejected from ejection side 58 of the tray 20 fall onto the slide fingers of the cover 60 and slide off of the outer edge of the cover 60 into the ice bin 24.

In the illustrated embodiment, motor 42 may be a stepper motor such as a Series LSD42 direct drive, 4 phase bifilar, stepping motor available from Hurst Manufacturing, a part of Emerson Motor Company, St. Louis, Mo. When such a motor 42 is utilized, the controller 30 includes a stepper motor controller 35 configured to control the rotational movement of the motor 42 by energizing the coils to start, stop and reverse the direction of the motor 42, as more particularly described hereafter. The disclosed stepper motor 42 is supplied with four wires (described in the literature accompanying the Series LSD42 motor as white, blue, red and black) for energizing the coils of the motor 42. The color coding described in the LSD42 motor literature will be utilized in describing the operation of the motor 42 and controller 30, however, those skilled in the art will recognize that more or fewer wires with different color coding may be used to energize the windings of other stepper motors.

The controller 30 induces clockwise rotation of the motor 42 by energizing the white and blue wires, white and red wires, black and red wires and black and blue wires in a cyclical fashion. The controller 30 induces counter-clockwise rotation of the motor 42 by energizing the black and blue wires, black and red wires, white and red wires and white and blue wires in a cyclical fashion. The stepper motor controller may be implemented on a separate integrated circuit 35, such as a Model 220001 stepper motor controller available from Hurst Manufacturing or the like. Alternatively the stepper motor controller may be implemented in the microprocessor or microcontroller 34 of the controller 30 or through separate logic circuitry within the scope of the disclosure.

Figure 2:
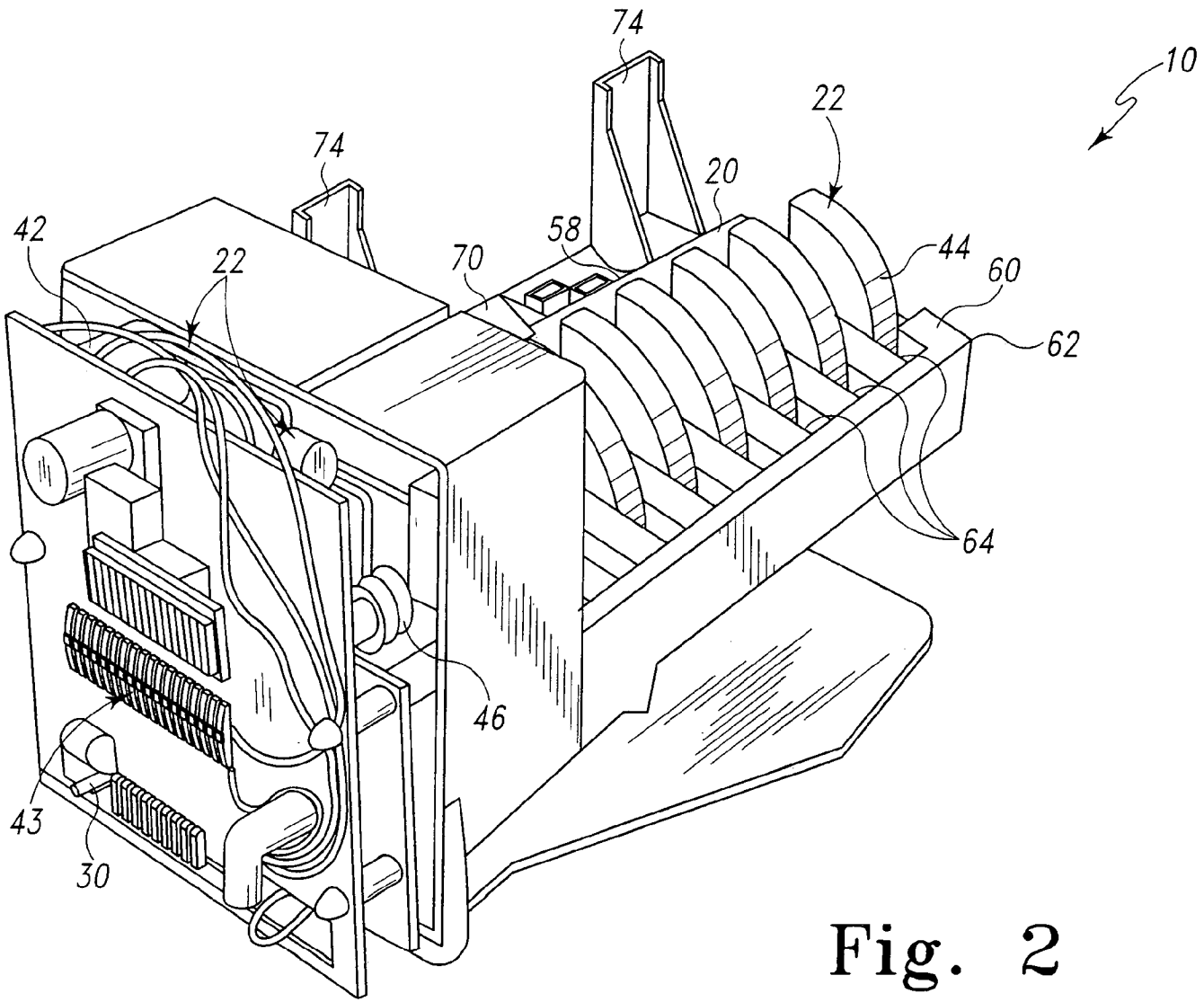
FIG. 2 is a perspective view of the icemaker assembly of FIG. 1 removed from the freezer compartment showing a cover removed from the control box to disclose a controller implemented in part on a PCB and a motor for rotating the ejector arm, the ejector members of which are shown partially inserted into compartments of the ice tray to act as displacement members.

In FIG. 2, a cover 41 (FIG. 1) is removed from the icemaker assembly 10 to expose a circuit board 43 containing the controller 30. As shown for example, in FIG. 4, the illustrated icemaker assembly 10 includes a controller 30 that is implemented at least in part by a microcontroller 34 and memory 40. While many microcontrollers, microprocessors, integrated circuits, discrete components and memory devices may be utilized to implement controller 30, the illustrated controller 30 utilizes a 72F324-J685 microcontroller from ST Microelectronics and EEPROM memory available as part number ULN2803A from Toshiba America Electronic Components Inc.

The disclosed microcontroller 34 receives signals from various sensors and components, such as the ejector arm position sensor 150, the over-fill level sensor 117 and the ice tray temperature sensor 160, to control various components, such as motor 42, heater 54 and the solenoid operated valve 32 in the water line 28, so that the icemaker assembly 10 operates in the manner described. The controller 30 drives the stepper motor 42 to move the ejector arm 44 and an ice bin bail arm (not shown). The controller 30 also selectively actuates a triac 33 to control the water valve 32, a triac 31 to control a heater 54 and a triac 37 to control a cooling fan 45. The controller 30 receives feedback from temperature sensor 160, the rotary detection emitter and sensor 152 providing position data relating to the ejector arm 44 and an optical sensor (not shown) to detect when the ice bin bail arm (not shown) is extended. The microcontroller 34 also reads data from and writes data to the memory 40. The memory 40 may store energized winding data, motor direction data, ejector arm position data, fill time data, fill level error data and other information useful to the operation of ice maker assembly 10.

As shown, for example, in FIGS. 17–21, the icemaker assembly 10 includes an ejector arm position sensor 150 coupled to the controller 30. Illustratively, the position sensor 150 is implemented using a rotary detection emitter and sensor 152 and an ejector arm encoder face cam 154 of the drive train 46. Illustratively, rotary detection emitter and sensor 152 may be an Optek PHOTOLOGIC® slotted optical switch, such as Part Number OPB961N51 available from Optek Technology, Inc., 1215 W. Crosby Road Carrollton, Tex. 75006.

The ejector arm encoder face cam 154 is one component of drive train 46 coupling motor 42 to the ejector arm 44. By sensing the position of the ejector arm encoder face cam 154, the position of the ejector arm 44 is established. The ejector arm encoder face cam 154 includes indicia 156 responsive to the rotary detection emitter and sensor 152 for indicating the angular position of the ejector arm 44. In the illustrated embodiment, indicia 156 includes a plurality of holes formed in the ejector arm encoder face cam 154 for permitting signals transmitted by the rotary detection emitter to propagate to the rotary position sensor.

Figure 18:
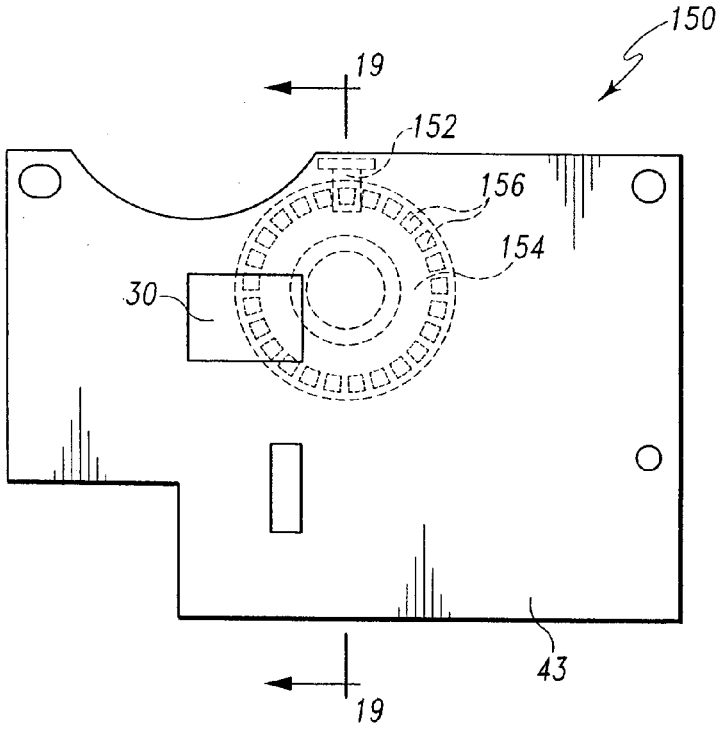
FIG. 18 is an elevation view of the PCB of FIG. 17 with the a rotary detection emitter and sensor and an ejector arm encoder face cam and indicia thereon shown in phantom lines.
Figure 19:
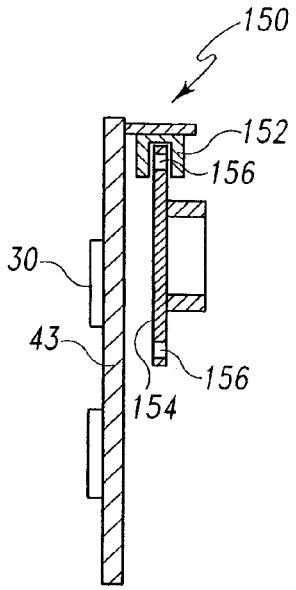
FIG. 19 is a sectional view taken along line 19—19 of the PCB, showing the rotary detection emitter and sensor, ejector arm encoder face cam and indicia of FIG. 18.

As shown for example, in FIGS. 18 and 19, the ejector arm encoder face cam 154 and rotary detection emitter and sensor 152 are mounted so that the ejector arm encoder face cam 154 rotates within the slot between the sensor and emitter in the rotary detection emitter and sensor 152. The solid portions of the ejector encoder face cam 154 interfere with the signal emitted by the rotary detection emitter when they are disposed between the emitter and sensor. Those skilled in the art will recognize that other indicia and rotary detection emitter and sensors, including indicia comprising reflective surfaces that reflect emitted signals onto a signal sensor are within the scope of the disclosure. It is within the scope of the disclosure for such reflective indicia to be coded so that the exact position of the ejector arm 44 can be determined during rotation.

Figure 13:
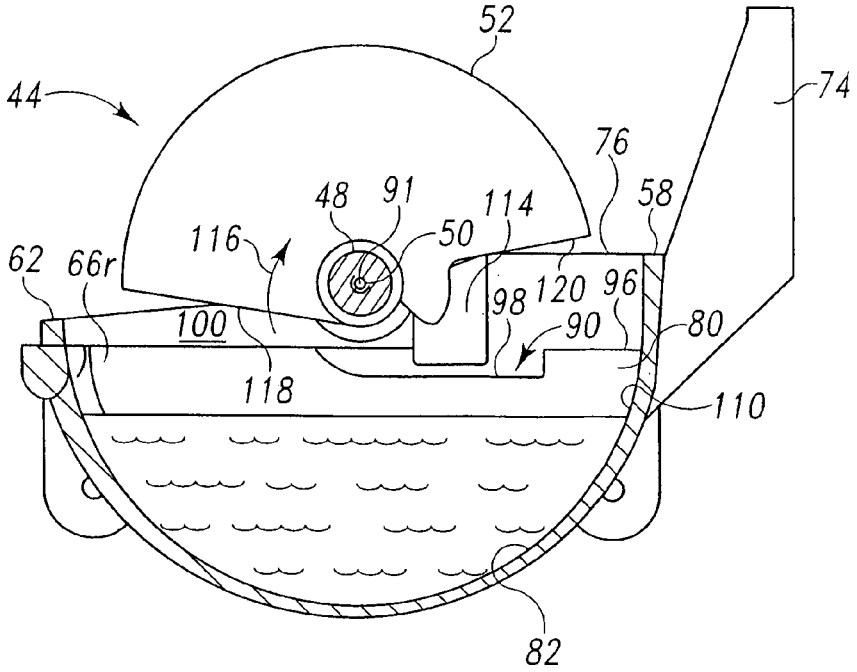
FIG. 13 is a sectional view similar to FIG. 9 following removal of the ejector member from the ice forming space of the compartment to a home position prior to ice forming in the compartment showing how the water level falls below the level of the overflow channel to eliminate formation of an ice bridge between adjacent cubes.

Preferably indicia 156 are present to selectively interfere, or not interfere, with the detection signal when the ejector arm 44 is positioned as shown at least in FIG. 13. Alternative methods and components may be used to detect the position of the ejector arm 44 within the scope of the disclosure including Hall sensor, tracking the energized winding of a stepper motor when such is used as the motor 42, strobes and optical sensors and the like.

Figure 21:
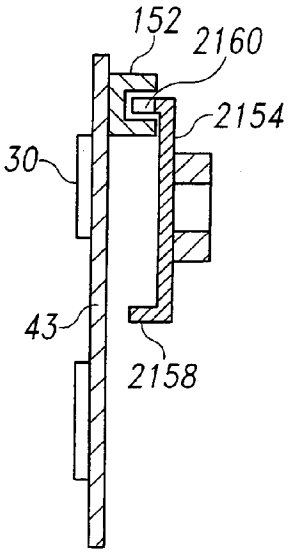
FIG. 21 is a sectional view similar to that shown in FIG. 19 showing the alternative drum-type ejector arm encoder face cam of FIG. 20, a PCB and a rotary detection emitter and sensor positioned to sense the indicia.
Figure 20:
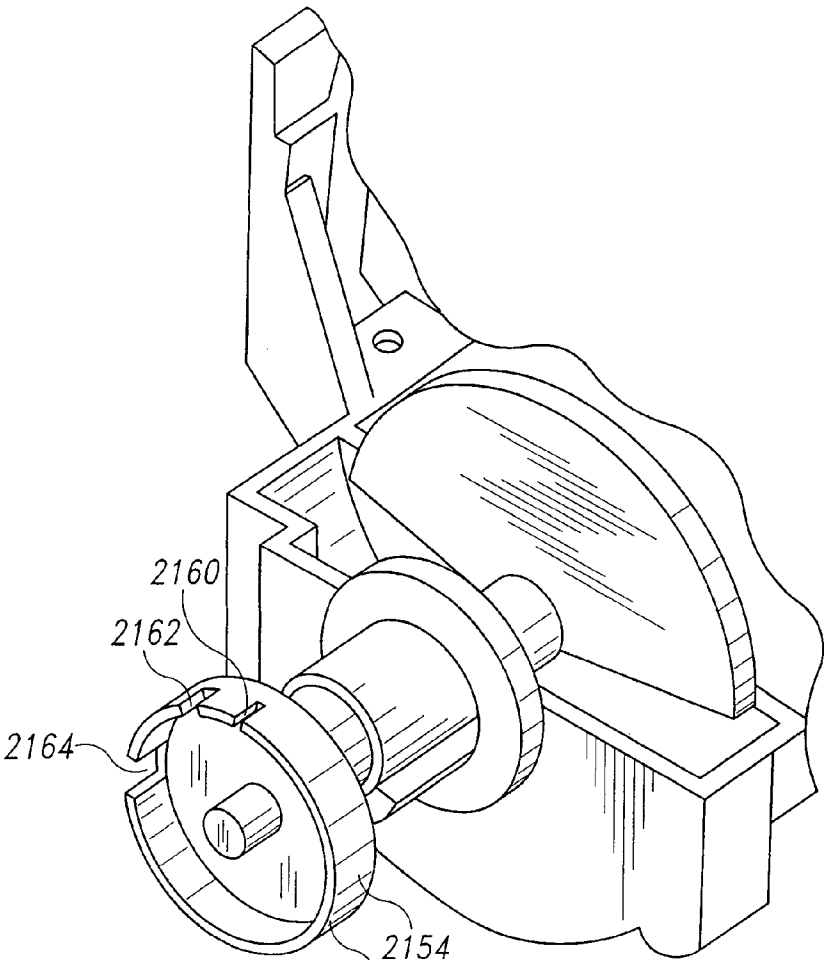
FIG. 20 is a perspective view of a portion of an ice tray, ejector arm and an alternative drum-type ejector arm encoder face cam having indicia formed as slots in a cylindrical axially extending wall.

As shown, for example, in FIGS. 20–21, a PCB 43 may include a rotation detector emitter and sensor 152 mounted in an orientation permitting a cylindrical axially extending wall 2158 of an alternative drum-type ejector arm encoder face cam 2154 to pass between its emitter and detector. Slots 2160, 2162 and 2164 are formed in the cylindrical axially extending wall 2158 to act as indicia 156. In the illustrated embodiment, indicia 156 include a home position slot 2160, a stall position slot 2162 and a heater disengagement slot 2164. Illustratively, rotation detection emitter and sensor 152 is mounted so that the home slot 2160 is positioned between the emitter and sensor when the ejector arm 44 is positioned to dispose the entire ejector member 52 outside of the ice forming cavities 66, i.e. in the home position such as that shown in FIG. 13. Those skilled in the art will recognize that a single home position slot 2160 would be sufficient to provide a calibration point for controlling the position of the ejector members 52 based on tracking the windings that are energized in a stepper motor or elapsed time and angular velocity or other open loop control algorithms for other electric motors.

Figure 14:
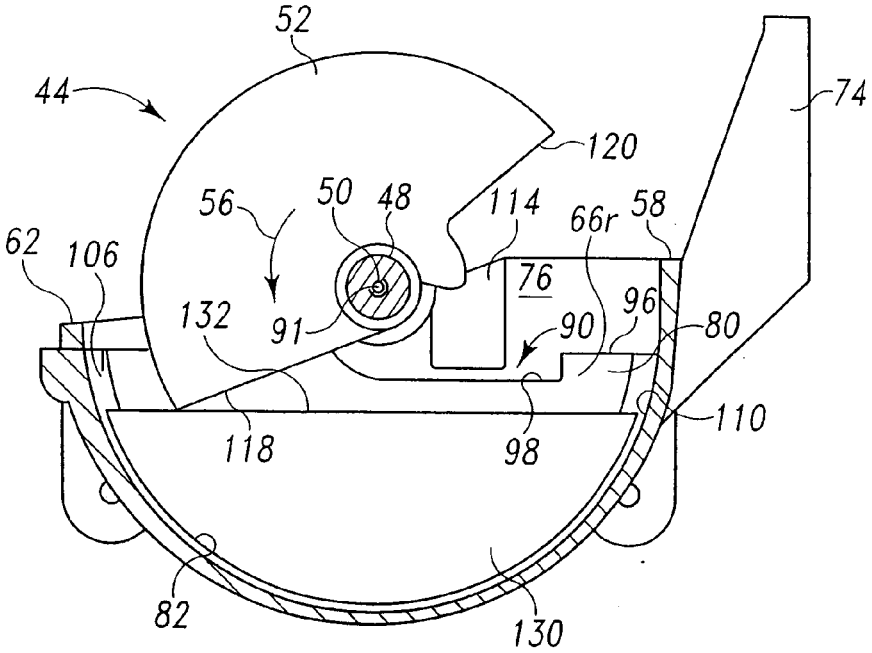
FIG. 14 is a sectional view similar to FIG. 9 after ice has formed in the compartment and the ejector arm has been rotated to bring the front face of the ejector member into contact with the top surface of the ice cube formed accurately representing either the ejector arm touching off on the narrow side of the ice cube to determine its size for implementation of the first embodiment of adaptively filling an ice tray or the ejector arm initiating an ejection cycle.
Figure 15:
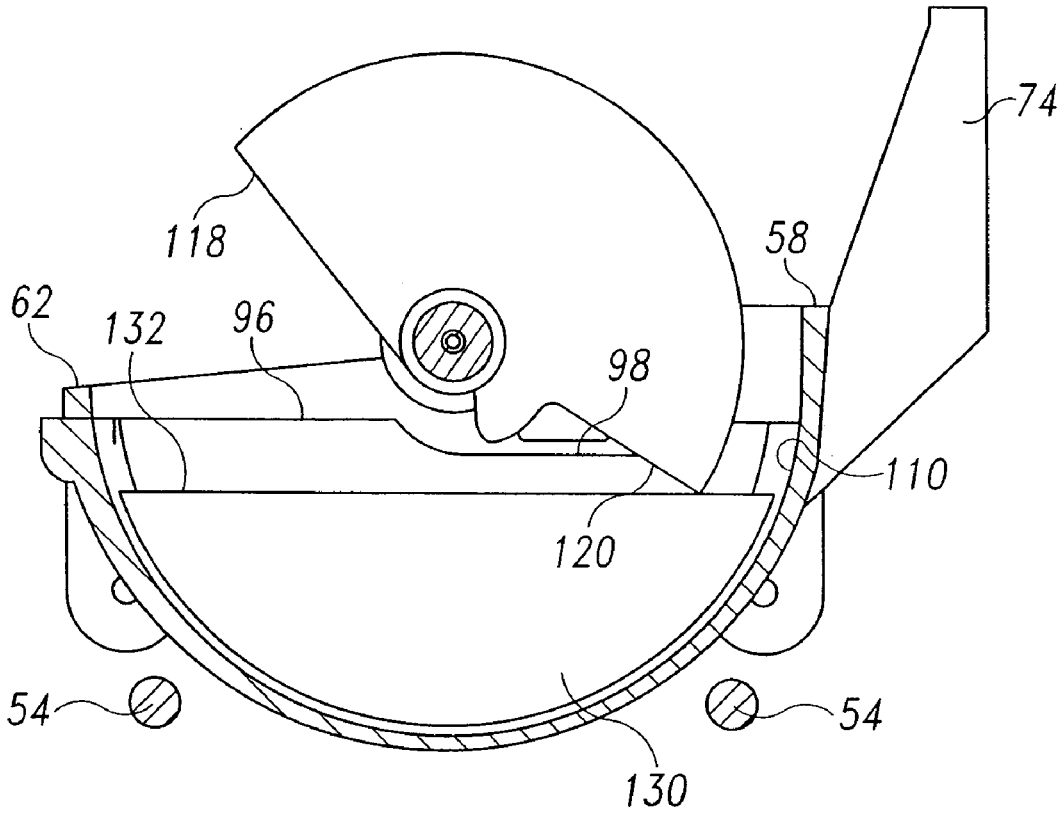
FIG. 15 is a sectional view similar to FIG. 14 after ice has formed in the compartment and the ejector arm has been rotated to bring the rear face of the ejector member into contact with the top surface of the ice cube formed showing the ejector arm touching off on the wide side of the ice cube to determine its size for implementation of the first embodiment of adaptively filling an ice tray.

As shown, for example, in FIG. 20, the stall slot 2162 is located on the cylindrical axially extending wall 2158 of the ejector arm encoder face cam 2154 so that the slot 2162 is disposed between the emitter and sensor of the rotation detection emitter and sensor 152 when the ejector members 52 are in a position where they are likely to engage ice formed in the ice forming compartments 66, i.e. in a position such as that shown in FIG. 14. Thus, sensor sends a stall condition signal to controller 30 during the period that it is able to detect the signal emitted by the emitter as a result of the stall slot 2162 being disposed between the sensor and emitter of the rotation detection emitter and sensor 152. During an ejection cycle, the stall condition signal indicates that the conditions are ripe for a motor stall. When the ejector members 52 first engage the ice formed in the ice forming compartment 104, the motor 42 and ejector arm 44 often stall. Thus, when the controller 30 receives a stall condition signal during an ejection cycle, the controller 30 is programmed to appropriately respond to a motor stall.

In the illustrated embodiment, during a filling cycle, the termination of the stall condition signal while the ejector arm is rotating in the direction of arrow 56 (FIGS. 3, 12 and 14) indicates to the controller 30 that the ejector members 52 have likely entered the space 104 in the ice forming compartments 66. By keeping track of winding energization when the stepper motor 42 is utilized, or through utilization of other open loop position control algorithms when another type of motor is utilized, the controller 30 can appropriately position the ejector members 52 to act as displacement members to displace the appropriate amount of water to make discrete ice cubes 130 of various sizes.

The heater slot 2164 is positioned on the cylindrical axially extending wall 2158 of the ejector arm encoder face cam 2154 relative to the emitter sensor to provide an indication that the ejector members 52 have rotated sufficiently into the ice forming compartments 66 to allow the heater 54 to be turned off during an ejection cycle. During a filling cycle, the controller 30 may utilize the signal generated by the sensor when the heater slot 2164 is disposed between the emitter and sensor to control the position of the ejector members 52 within the ice forming compartments 66.

The various positions of the ejector arm 44 are defined in terms of number of motor steps from home position (FIG. 13) moving either in the harvest direction, the direction the arm 44 rotates during a harvest, or in the reverse direction, the direction opposite the harvest direction. In the illustrated embodiment, a full rotation of the ejector arm 44 is four thousand three hundred twenty (4320) motor steps. Those skilled in the art will recognize that the number of motor steps for complete rotation of the ejector arm 44 is dependent on the type of stepper motor 42 utilized and the gearing of the drive train 46.

In use, water is released from the water inlet 28 and flows down the end water inlet ramp 68 into the rear compartment **66*r*. During the filling process, a portion of each ejector member 52 is disposed in the ice forming space 104 of its associated compartment as shown, for example, in FIGS. 9–11. The positioning of the ejector members 52 to act as displacement members is described more fully below. When sufficient water has entered the rear compartment 66*r* to raise the level of the water in the compartment 66*r* to the level of the top surface 98 of the overflow channel 90, water overflows into the adjacent compartment 66 until the adjacent compartment 66 overflows into its adjacent compartment 66. This fill and overflow process continues until water has filled each compartment 66**.

Initially, in a first embodiment of the disclosure (as described more fully below), the fill time is based on the required time to fill the ice tray 20 to a particular location at which a known portion of the entire volume of the tray 20 has been filled and continued for a time proportional to the remaining volume of the tray 20 and the time required to fill to the particular location. In an alternative embodiment of the disclosure, the level of the water in the last compartment **66*f* to be filled may be sensed. In yet another embodiment of the disclosure, the water filling operation is based on a set time that is calibrated to estimate proper filling of all of the compartments 66 of the tray 20. In each of the embodiments, the total time that the water solenoid valve 32** is open is adjusted in either the current or subsequent filling cycles based on a determination of a fill level error.

Cessation of the filling operation may be accomplished in various ways, however, the illustrated icemaker assembly 10 closes a solenoid valve 32 positioned in the water line 28 between the water source 18 and the outlet of the water line 28 to stop the filling operation.

As mentioned above, the controller 30 controls the motor 42 to position a portion of the ejector member 52 in the ice forming compartment 66 at some time during the filling operation to displace water. In the illustrated embodiment, the controller 30 controls the motor 42 to rotate the ejector arm 44 to submerge the entire ejector member 52 or a portion of the ejector member 52 adjacent the front face 118 or rear face 120 in the compartment 66 to act as displacement members during a filling cycle.

Figure 9:
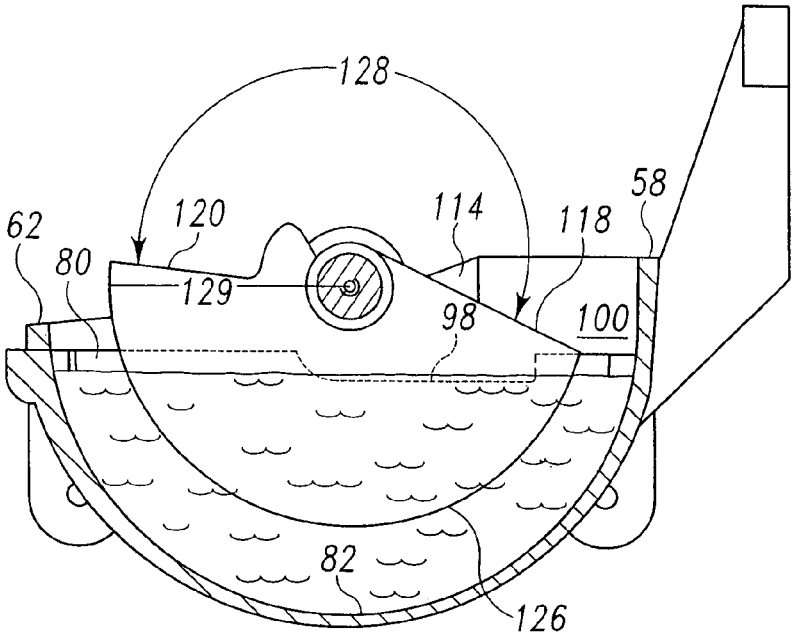
FIG. 9 is a sectional view of the ice tray and ejector arm taken through the rear compartment adjacent the rear end wall looking toward the front end wall during the fill operation showing the ejector arm positioned with an ejector member extending into the ice forming space of the compartment to act as a displacement member for displacing water that is flowing over the overflow channel.

In one current embodiment of icemaker assembly 10, the motor 42 is stopped during filling to dispose a maximum volume of the ejector member 52 in the compartment 66 in the Fill Position, as shown, for example, in FIG. 9, to displace water so that a minimum sized ice cube 130 can be formed. The Fill Position is defined as a number of steps from Home Position in the harvest direction. The Fill Position is read from the EEPROM memory 40 on power-up. If a value cannot be read from the memory 40, the default value of the Fill Position is one thousand eighty motor steps (90°) from the home position which disposes less than the maximum volume of the ejector member 52 in the compartment 66.

Figure 10:
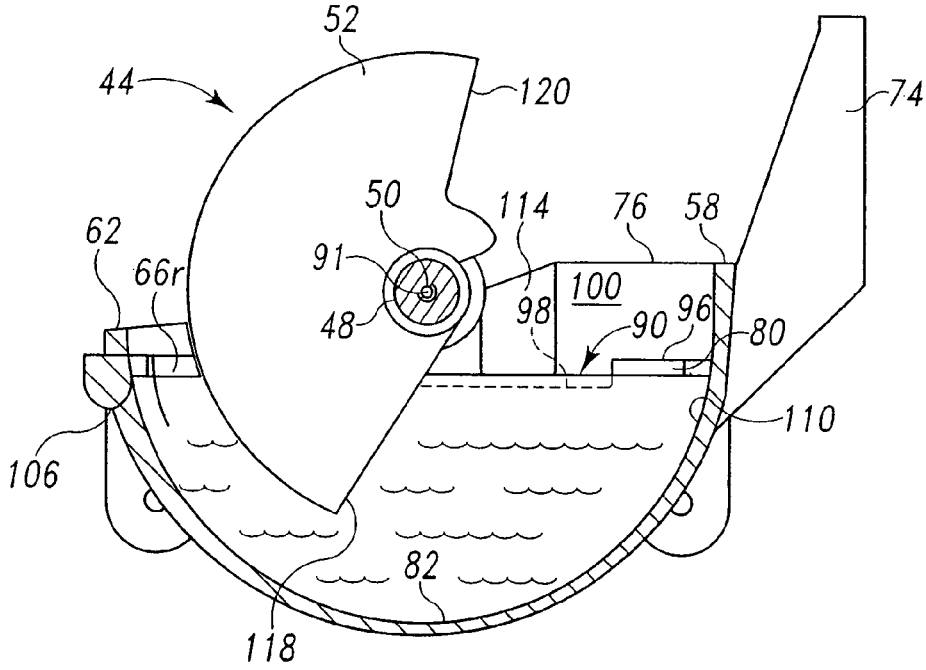
FIG. 10 is a sectional view similar to FIG. 9 showing a front portion of the ejector member disposed in the ice forming compartment to displace less water than when the ejector member is positioned as shown in FIG. 9 to permit larger ice cubes to be formed in the compartment, FIG. 10 also shows one position that the ejector member may take during stirring of the water while cooling or while determining the fill level error utilizing the second embodiment of adaptively filling an ice tray.
Figure 11:
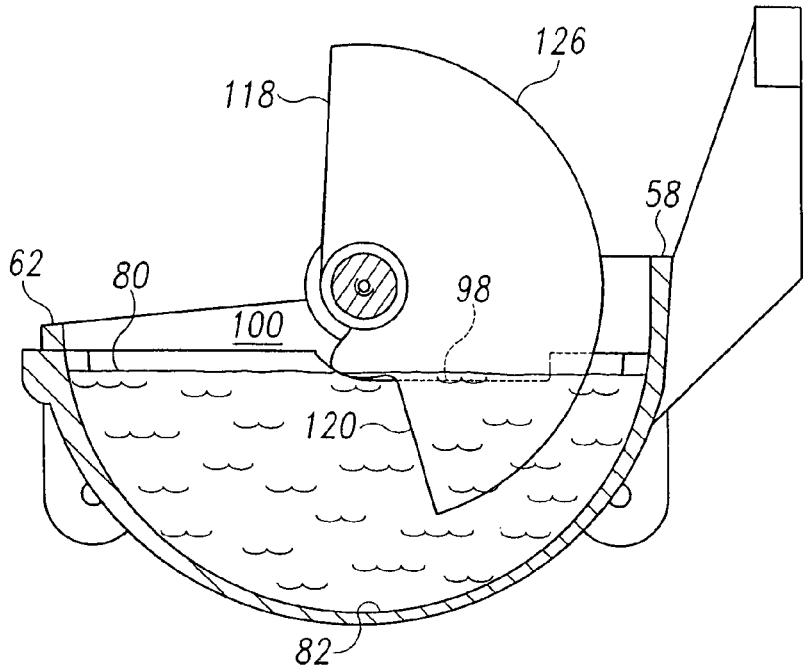
FIG. 11 is a sectional view similar to FIG. 10 showing a rear portion of the ejector member disposed in the ice forming compartment to displace less water than when the ejector member is positioned as shown in FIG. 9 to permit larger ice cubes to be formed in the compartment, FIG. 11 also shows one position that the ejector member may take during stirring of the water while cooling or while determining the fill level error utilizing the second embodiment of adaptively filling an ice tray.
Figure 12:
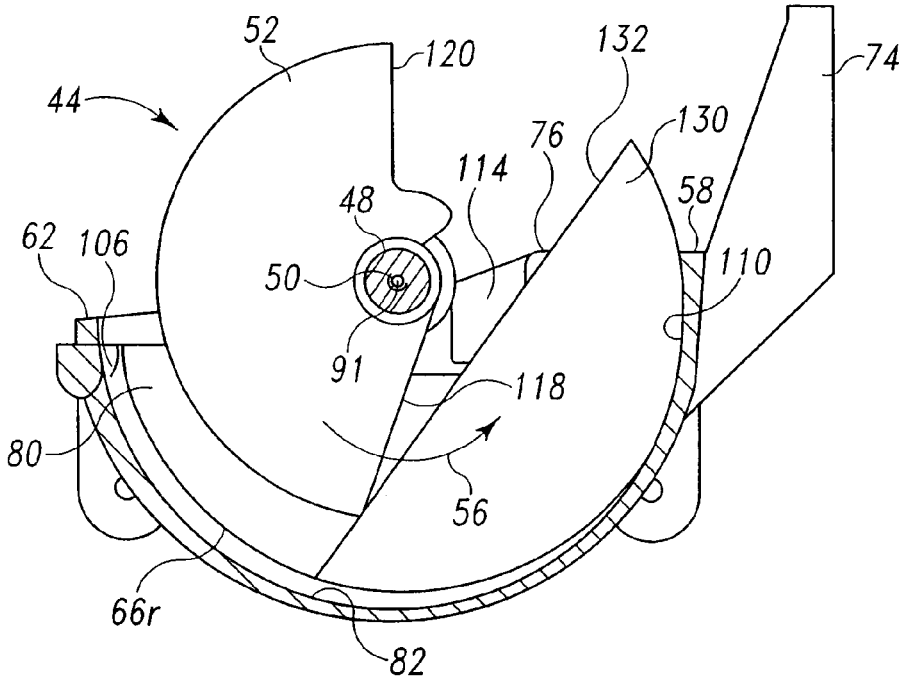
FIG. 12 is a sectional view similar to FIG. 9 after the ejector arm has rotated partially into the ice forming space to urge the ice cube formed in the compartment along an ejection path of motion.

Those skilled in the art will recognize that the motor 42 can be stopped during filling to dispose a portion adjacent the front face 118 of the ejector member 52 in the compartment 66, as shown, for example, in FIG. 10, to form a larger ice cube 130. Alternatively, the motor 42 can be stopped during filling to dispose a portion adjacent the rear face 120 of the ejector member 52 in the compartment 66, as shown, for example, in FIG. 11, to form a larger ice cube 130. Those skilled in the art will recognize that the size of the ice cube 130 to be formed can be controlled by controlling the volume of the ejector member 52 positioned in the ice forming space 104 of the compartments 66. This can be controlled by controlling the angular position of the ejector arm 44 by limiting the number of steps that the motor 42 is driven by the controller 30.

At some time after a filling cycle is completed, the controller 30 controls the motor 42 so that rotation of the ejector arm 44 is stopped with the ejector members 52 disposed completely outside the ice forming space 104 of each compartment 66 in the home position, as shown, for example, in FIG. 13, for a period of time to permit water to freeze in the ice tray 20. After the water is frozen in the ice tray 20, the controller 30 enables motor 42 to drive the ejector arm 44 in the direction of arrow 56, i.e. in the harvest direction, causing ice in the tray 20 to be forced out of the ejection side 58 of the tray 20. In the illustrated embodiment, ejection side 58 of the tray 20 is the side of the tray 20 adjacent the side wall 16 of the freezer compartment 12 to which the ice maker assembly 10 is mounted.

If stirring while freezing is implemented, the controller 30 assumes the Freeze Stir state after the Fill Valve Open state. In the Freeze stir state, the controller 30 drives the ejector arm 44 to stir the water with the ejector members 52 in fast/low torque mode while the water valve 32 is closed and the heater 54 is off. During cooling, the controller 30 drives the motor 42 to repeatedly position portions of the ejector members 52 in the compartments 66 to stir the water therein as it cools toward freezing. The Stir Forward Position is defined as number motor steps from Home Position that the motor 42 should be advanced during stirring while cooling. If this value is zero, then the stirring is accomplished by continuously rotating the ejector arm 44 in the harvest direction. This value is read/write from EZ-Link. It is read from the EEPROM 40 on power-up. If a value cannot be read from the EEPROM 40 the default is two thousand one hundred motor steps (175°) from the home position. The value is written to the EEPROM 40 when a Harvest Arm Data Set message is received.

The Stir Backward Position is defined as number motor steps from Home Position moving from the Stir Forward position in the reverse direction. If this value is zero, then stirring involves continuously rotating the ejector arm 44 in the harvest direction. The Stir Backward Position is read from the EEPROM 40 on power-up. If a value cannot be read from the EEPROM 40, the default value of the Stir Backward Position is eight hundred motor steps (67°) from home. The value is written to the EEPROM 40 when a Harvest Arm Data Set message is received.

Once the temperature of the water has lowered to a setpoint temperature close to the freezing point, the controller 30 assumes the Freeze Stir Home state wherein stirring is ceased and the ejector arm 44 is sent to the home position in fast/low torque mode. In the illustrated embodiment, a Stop Stir temp and a Stop Stir time are stored in memory 40. The Stop Stir temp indicates the setpoint temperature and the Stop Stir time the duration at which the sensed temperature should be at or below the setpoint temperature during a stir cycle, before the stir cycle ends and the ejector arm 44 is removed from the tray 20. The Stop Stir time and Stop Stir temp are read from the EEPROM 40 on power-up. If values cannot be read from the EEPROM 40, the default value for Stop Stir temp is approximately 1° C. and the default value for Stop Stir time is five seconds. Both values are written to the EEPROM 40 when a Control Temperature/Timing Set message is received.

Once the ejector arm 44 has reached the home position, the controller 30 assumes a Freeze Finish state in which the motor 42 is not driven, the heater 54 is off and the water valve 32 is closed. The controller 30 remains in the Freeze Finish state until the water freezes.

If stirring while cooling is not implemented in the ice maker assembly 10, the controller 30 assumes the Freeze Home state immediately after the Fill Valve Open State to bypass stirring and immediately drive the motor 42 to send the ejector arm 44 to the home position in fast/low torque mode.

Filling of the tray 20 takes place in either the Fill Valve On or the Fill Valve Cold states. The algorithm in both states is exactly the same. The only difference is that Fill Valve On exits to Freeze Stir, and Fill Valve Cold exits to Freeze Home. The controller 30 assumes a Freeze Contingency state to bypass stir and touch off when there has been an error during harvest and there is likely excess water in the tray 20 that should be frozen and harvested so following fills do not overfill.

At some time prior to the water freezing in each compartment 66, the ejector arm 44 is turned until the entire ejector member 52 is disposed outside of the ice forming space 104 in each compartment 66, as shown, for example, in FIG. 13. The ejector members 52 are disposed completely outside the ice forming space 104 of each compartment 66 in the home position for a period of time to permit water to freeze in the ice tray 20.

In the first and second disclosed embodiments of an ice maker assembly 10 implementing adaptive filling of the ice tray 20, the controller 30 drives the motor 42 and tracks the position of the ejector arm 44 to allow the ejector members 52 to be utilized as level detectors to help determine the fill level of the ice tray 20. In the first embodiment of the disclosed ice maker assembly 10 implementing adaptive filling of the ice tray 20, after the water freezes in the ice forming compartments 66, the ejector members 52 are rotated into contact with the top surface 132 of the ice cubes 130 to sense the size of the ice cube 130 formed in the present cycle in a touch-off method of adaptive filling 1600. In an alternative embodiment of a method of adaptive filling 2200, prior to the water freezing in the ice forming compartments 66, the ejector members 52 are rotated into the ice forming space 104 in the compartments 66 to cause the water level therein to rise to actuate a sensor to sense the water fill level in the present cycle. In either of these two embodiments 1600, 2200, knowing the position of the ejector members 52 facilitates determining the level to which the ice tray 20 was filled.

In the illustrated embodiments, the controller 30 assumes a Harvest Ready state when the water is frozen in the ice tray 20. In this state, the ejector arm 44 is positioned so that the ejector members 52 are located completely outside of the ice forming space in the compartments 66, i.e. in a home position, the heater 54 is off and the water valve 32 is closed. The controller 30 waits in this state if a bail arm (not shown), or other ice bin fill level indicator, is in a position indicating that the ice bin 24 is full. Otherwise, the controller 30 begins to rotate the ejector arm 44 to begin either the ejection process or to determine the size of the ice cubes 130 that have been produced after the temperature of the ice drops to a Freeze Temp for an appropriate time Freeze Time. The pre-selected values of Freeze Temp and Freeze Time are stored in memory 40 and are selected so that when the values are met it can be safely assumed that the water is completely frozen following a stir cycle. These values are read from the EEPROM 40 on power-up. If a value cannot be read from the EEPROM 40, the default value for Freeze Temp is −7° C. and the Freeze Time default value is thirty seconds. Both values are written to EEPROM 40 when a Control Temperature/Timing Set message is received.

In each of the disclosed embodiments, at some time after an ice cube 130 has formed in each compartment 66, the controller 30 actuates the heater 54 which heats the tray 20 to expand the same and melt a small amount of ice cube 130 adjacent the walls of each compartment 66. The controller 30 assumes the Harvest Thaw state when the ejector members 52 of the ejector arm 44 are pushing on the ice 130 in slow/high torque mode. In this state, the heater 54 is on, the motor 42 is being driven in a slow/high torque state and the water valve 32 is closed. The melting of the cube 130 is believed to provide a lubrication layer between the ice cube 130 and the walls of the compartment 66. The controller 30 actuates the motor 42 to turn its output shaft which is coupled through the drive train 46 to the ejector shaft 48. The motor 42 drives the ejector shaft 48 to rotate about the rotation axis 91 in the direction of arrow 56 inducing the front face 118 of each ejector member 52 into contact with the ice cube 130 formed in its associated compartment 66, as shown, for example, in FIG. 14. The front face 118 of each ejector member 52 contacts the top surface 132 of its associated ice cube 130 adjacent the narrow end of the cube 130 and exerts a force driving the narrow end of the cube 130 downwardly along the arcuate bottom surface 82 of the compartment 66.

The controller 30 assumes a Harvest Finish state when the ejector arm 44 has started to move while in the Harvest Thaw state indicating that the tray 20 has expanded sufficiently or enough of the ice cube 130 adjacent the tray 20 has melted to permit the ice cube 130 to be driven along the ejection path of motion. In the Harvest Finish state, the controller 30 drives the motor 42 in a fast/low torque mode along the ejection path of motion until it reaches the home position. While in the Harvest Finish state the controller 30 turns off the heater 54 and maintains the water valve 32 closed.

The controller 30 assumes a Harvest Error state when a thaw cycle time has expired and the ejector arm 44 has not begun to drive the ice cubes 130 out of the ice tray 20 along the ejection path of motion. In the Harvest Error state, the controller 30 drives the motor 42 to move the ejector arm 44 back and forth in slow/high torque mode while it continues to cycle the heater 54 until the ejector arm 44 begins to move along the ejection path of motion. Once the ejector arm 44 begins to move along the ejection path of motion, the controller 30 assumes the Harvest Error Home state, similar to the Harvest Finish state, to drive the motor 42 in a fast/low torque mode to move the ejector arm 44 to the home position.

Once the ejector arm 44 has proceeded along the ejection path of movement a sufficient distance to completely eject the ice cubes 130 from each compartment 66, the controller 30 assumes a Fill Tray Cool state after leaving the Harvest Finish or the Harvest Error Home state, to permit the tray 20 to cool down so that when water is introduced it will provide a detectable change in temperature. During the Fill Tray Cool state, the ejector arm 44 is in the home position, the motor 42 is not being driven, the heater 54 is off and the water valve 32 is closed.

After a sufficient time passes for the empty tray 20 to cool, the ejector member 52 is positioned so that a portion of the ejector member 52 is disposed in the ice forming space 104 in the compartment 66 to displace water during the next fill operation. The controller 30 thus assumes a Fill Arm Position state. In the Fill Arm Position state, the controller 30 drives the motor 42 to move the ejector arm 44 into the desired fill position, as shown for example, in FIGS. 9–11. While in the Fill Arm Position state, the heater 54 is off and the water valve 32 is initially closed. The controller 30 assumes a Fill Valve Open state while filling. This is the primary fill state wherein the motor 42 is not driven, the heater 54 is off and the water valve 32 is open.

In the first embodiment of the disclosed method 1600 of adaptively filling an ice tray 20, the ice tray 20 is initially filled with water by leaving the water valve 32 open for a period of time (the Fill Time) in a fill step 1602, and then the ejector arm 44 is used to detect the size of the ice cube 130 formed in the tray 20 in a detection step 1604. The Fill Time is adjusted in a fill adjustment step 1606 for the next or a subsequent filling cycle based on the error between the detected size of the cube 130 and the desired size of the cube 130. Illustratively, the size of the ice cube 130 is detected by rocking the ejector arm 44 back and forth into contact with top surface 132 of the wide end and the top surface 132 of the narrow end of the frozen ice cube 130. The angular position of the ejector arm 44 is recorded when the ejector arm 44 stalls due to contact of an ejector member 52 with the top surface 132 of its associated ice cube 130. This data is then used in future fill cycles to maximize the size of the cubes 130 by adjusting the Fill Time.

The first disclosed embodiment of adaptive filling of an ice tray 1600 utilizes the temperature sensor 160 to detect the presence of water at a water detect point during the initial fill step 1602. In the illustrated embodiment, the temperature sensor 160 is located in the center compartment 66*c* of the ice tray 20 and the overflow method is utilized to fill the ice tray 20. The tray 20 is allowed to cool following the previous ejection cycle. After determining that the tray has cooled sufficiently 1608, the water valve is opened 1610 and the clock is started 1612. The controller 30 monitors the temperature sensed at the detection point 1614 by the temperature sensor 160 to determine if there has been a temperature change 1616. When a temperature change is detected it is determined whether the temperature change is of sufficient magnitude and duration to indicate the presence of water at the detection point 1618.

Since the water is introduced into the rear compartment 66*r*, when the water finally overflows into the center compartment 66*c* inducing a change in the temperature of the center compartment 66*c*, approximately half of the volume of the water required to fill all of the compartments 66 of the tray 20 has been dispensed. Thus, upon the temperature sensor 160 detecting a change in the temperature of the center compartment 66*c* induced by the presence of water in the center compartment 66*c*, it may be assumed that an equal volume of water needs to be dispensed to fill all of the compartments 66 of the ice tray 20. Thus, if the water valve 32 was open for a time period prior to the temperature sensor 160 sensing a change in temperature, it can be assumed that the water valve 32 should be left open for an equivalent time period to completely fill the tray 20.

In the first embodiment of the method of adaptively filling an ice tray 20, the time differential between opening the solenoid valve 32 and the detection of a change in temperature of the center compartment 66*c* is stored in memory 40 as a Water Detect Point value 1620. This Water Detect Point value is utilized to calculate the total time that the water valve 32 should remain open, or the Fill Time in the Fill Time calculation step 1622. In the Fill Time calculation step 1622, the controller 30 uses the following equation:

Water Detect Point+Water Detect Point*Fill finish %=Fill Time.

Initially, the Fill finish % is set based on the ratio of the volume of ice compartments 66 of the tray 20 beyond the detect point to the volume of the compartments 66 of the tray 20 up to the detect point. In the illustrated embodiment, since the detect point is in the center compartment 66*c* at a location where the tray 20 should be half full when a temperature change is detected, the Fill finish % is initially set to one (1.00). Those skilled in the art will recognize that if the detect point is positioned at a different location in the tray 20 then the initial Fill finish % value would be different. For example, if the temperature sensor 160 were located to detect a temperature change in a compartment 66 which receives water when the tray 20 is one-quarter full, the initial Fill finish % would be set to three (3.00).

The controller 30 utilizes both a timer and a detected change in temperature to control the filling of the tray 20 and to implement adaptive filling. The controller 30 utilizes clock pulses to keep track of how long the water valve 32 is on. Once it is determined that the Fill Time has elapsed 1624, the water valve 32 is closed 1626. If there is a power down in a fill state this value of the time elapsed since opening the water valve 32 is written to EEPROM 40 so that the filling step 1602 can continue upon restoration of power.

Figure 16A:
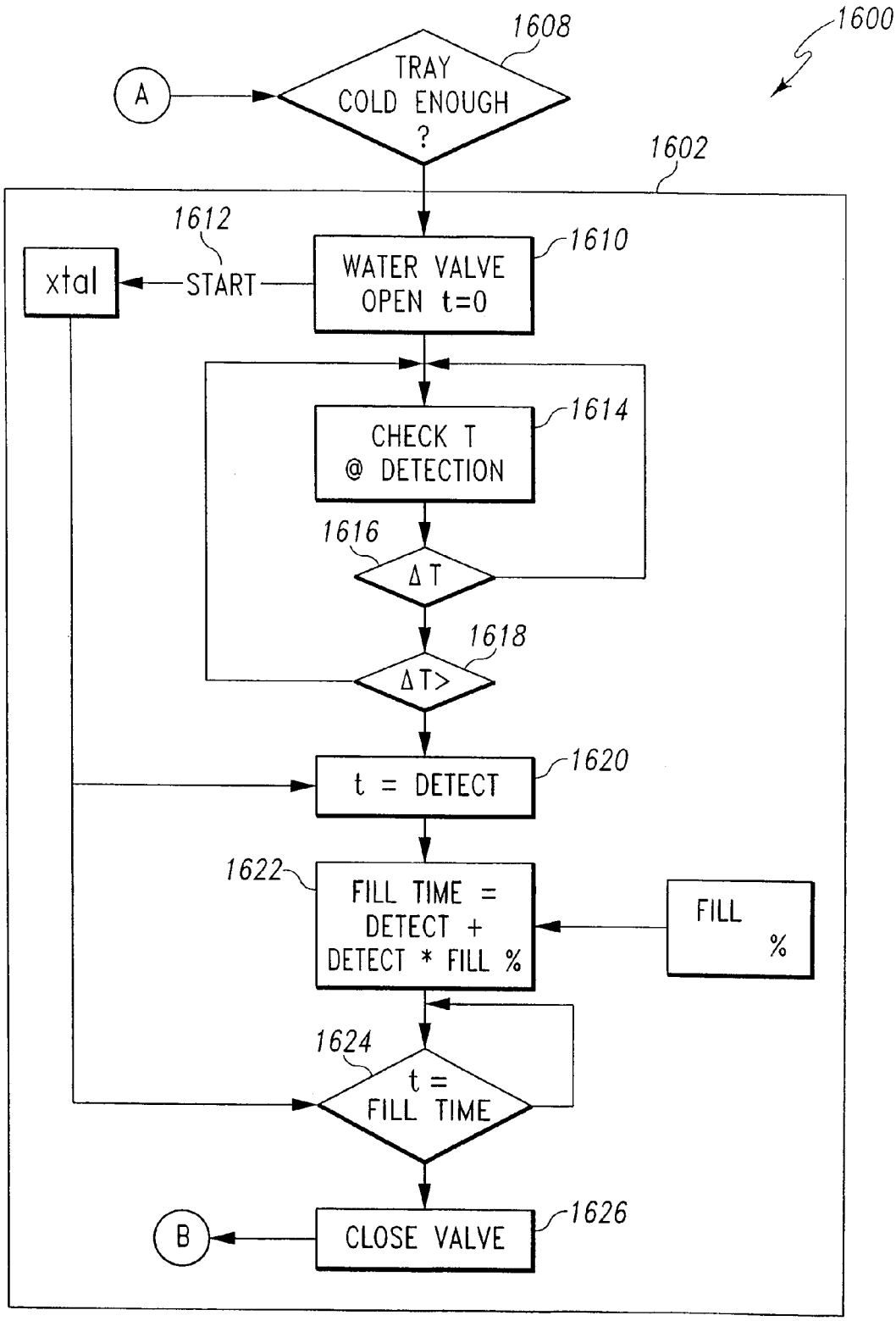
FIGS. 16A and B are a flow diagram of a method of adaptively filling an ice tray wherein the ejector members are utilized to touch off on the ice cubes formed to determine the size of the cubes.

While not shown in FIG. 16, the controller 30 tries to detect the presence of water at the detect point for a time period determined by the value of Fill Search Time, which is in units of line ticks. In the illustrated embodiment, the output of the temperature sensor 160 is converted from analog to digital and a number of analog to digital pulses or A/D counts are utilized to represent the sensed temperature. As water fills the tray 20 and fills the center compartment 66*c* in which the temperature sensor 160 is located, the water, because it is warmer than the tray 20, causes a change in the temperature sensed by the temperature sensor 160. Thus, once the water valve 32 is opened by the controller 30, the controller 30 begins to compare temperature data received from the temperature sensor 160 to detect a temperature change 1616.

In the illustrated embodiment anytime two subsequent temperature sensor readings differ by one count of A/D, the time is recorded as a possible Water Detect Point. Then 1.2 seconds later, the possible Water Detect Point is verified as a legitimate temperature change, if the latest A/D reading is 5 counts or greater higher than the A/D reading at the possible Water Detect point. If it is not, the controller 30 looks for a new possible Water Detect Point between the present reading and all readings following the original possible Water Detect Point. If a new possible Water Detect Point cannot be found it simply continues to search. If the possible Water Detect Point is verified then the time from when the valve 32 was turned on until the possible Water Detect Point is considered the Water Detect Point. The Fill finish % is multiplied by the Water Detect Point to determine how much longer the valve 32 should remain on. This remaining valve on time is the Fill Finish Time. The fill will continue until the Fill Finish Time expires as long as the Water Detect Point+Fill Finish Time does not exceed the Max Fill Time. The water valve 32 can never be on for longer than the Max Fill Time. If no temperature change induced by water filling the tray 20 is ever detected, the Water Detect Point and the Fill Finish Time are set to zero, and the water valve remains on for the Fill Search Time only.

Generally, as described above, the amount of time that the water valve 32 is opened is determined by time lapse between opening the water valve 32 and the detection of a temperature increase by the tray sensor 160 (the Water Detect Point) which is then added to the Water Detect Point multiplied by the Fill finish % to determine the Fill Time. However, to avoid overfilling of the tray, a Max Fill time is provided. Illustratively, the water valve 32 cannot be open for more than the Max Fill time for a single fill cycle. Thus, even if a temperature change is detected, thereby establishing a Water Detect Point, if the Fill Time calculated from the values of the Water Detect Point and the Fill Follow % is greater than the Max Fill time, the water valve 32 will be shut when the Max Fill time elapses rather than waiting for the calculated Fill Time to elapse.

It may be preferable in some situations where the Water Detect Point is found to vary without a corresponding variance in water pressure to provide a digital filter to the Water Detect Point. Such a filter is implemented in one embodiment of the disclosed device and method by substituting a New Filtered Data value for the Water Detect Point in the above equations. The New Filtered Data value is defined as:

$$NewFilteredData = \frac{(\text{weight}-1)*PreviousFilteredData+WaterDetectPoint}{weight}$$

where the Previous Filtered Data is the value of the New Filtered Data from the previous fill cycle, the weight is a filtering factor and the Water Detect Point is the actual measured detect time in the current fill cycle. The weight is a value between 0 and 1 and desirable results have been obtained utilizing weight=0.4. Those skilled in the art will recognize that utilization of the digital filter will limit the ability of the described algorithm to compensate for momentary increases or decreases in water pressure experienced during the current filling cycle, but will still allow the algorithm to compensate for slow pressure drops in the fill line arising from clogging of the water line over time.

The illustrated embodiment also stores a Fill Search Time which limits the amount of time the controller 30 will wait for the presence of water to be detected. If water is not detected prior to the Fill Search Time, the Fill Search time is utilized as the value of the Fill Time. The value is written to the EEPROM 40 when a Fill Time Set message is received.

The Fill Finish Time is the amount of time the water valve 32 will stay open after the time that water is detected by the temperature sensor 160 sensing a temperature change. As previously stated, the value of the Fill Finish Time is calculated by multiplying the Water Detect Point by the Fill finish %. The Fill finish % is the percentage of the Water Detect Point that the water valve 32 should stay open after the time when the presence of water is detected at the detect point. The value of the Fill finish % is written to the EEPROM 40 when a Fill Time Set message is received.

The EEPROM 40 also stores a value for the Fill Temp Delta Threshold. The Fill Temp Delta Threshold is the number of counts of A/D change in the temperature reading sensed by the temperature sensor 160 over a 1.2 second time period that will indicate the presence of water at the detect point.

After it is determined that the water has frozen 1628, the ejector members 52 are utilized to measures height of the surface of the ice cubes 1604 by touching off on the top surface 132 of the ice cubes 130. If the ice cubes 130 are smaller than the ideal touch off value then the Fill finish % is increased 1630. Likewise if the ice cubes 130 are too large the Fill finish % is decreased 1632. Preferably the part of the ejector member 52 that contacts the ice cube 130 should be the one farthest from the shaft 48. The illustrated ice maker assembly 10 includes ejector members 52 having planar front and rear faces. Ejector members 52 configured in such a manner are particularly useful in an ice maker assembly 10 that eliminates bulges on the top surface 132 of the ice cube 130. A method and device for, among other things, eliminating such surface bulges that utilizes the disclosed ejection members 52 is disclosed in co-pending U.S. patent application Ser. No. 10/895,665 filed Jul. 21, 2004, entitled Method and Device for Stirring Water During Icemaking, which is assigned to the same assignee as the present invention, the disclosure of which is hereby incorporated by reference in its entirety. When water is not stirred during ice making, it may be advantageous for ejection members having differently configured faces to be utilized, such as a concavely curved face or a face having a downwardly projecting finger adjacent the outer wall.

Figure 16B:
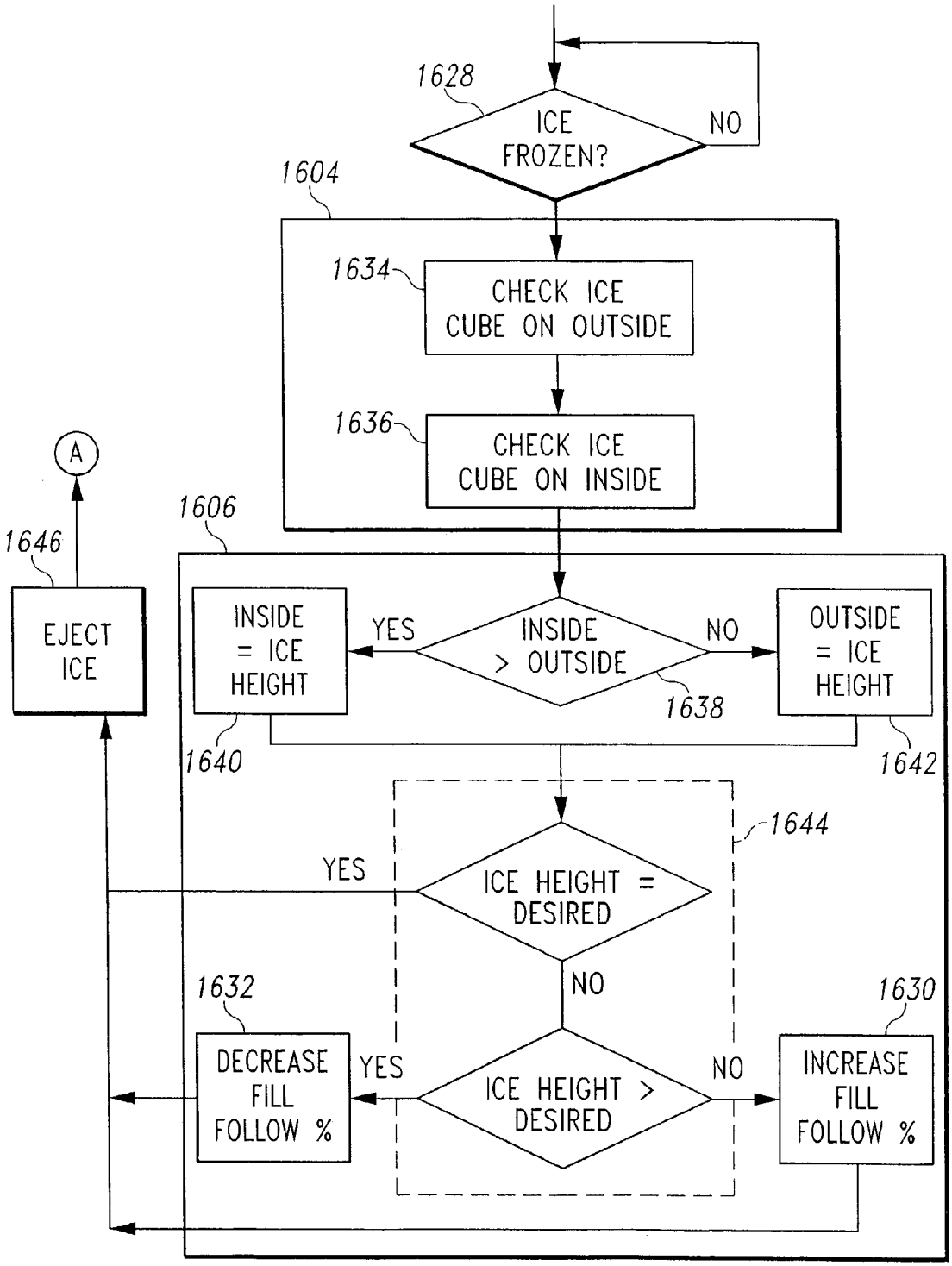
Figure 17:
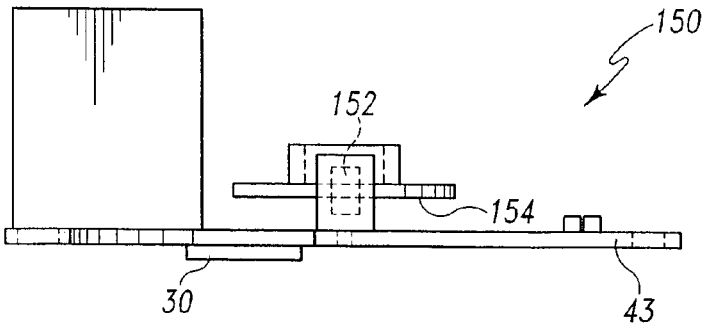
FIG. 17 is an elevation view of portions of the PCB with components removed for clarity showing a transformer, a rotary detection emitter and sensor and an ejector arm encoder face cam of the drive train for detecting the position of the ejector arm.

In one illustrated embodiment, wherein the ice maker assembly 10 utilizes the touch-off technique for implementing adaptive fill 1600, as shown for example in FIG. 16B after the Freeze Finish state, the controller 30 assumes the Freeze Harvest Direction Touch Off ("Freeze HD Touch Off") state to perform a narrow side ice level determination step 1634. The Freeze HD Touch Off state is assumed after the water has frozen to determine the height of the ice 130 by stalling the ejector arm 44 on the top surface 132 of the ice cube 130 adjacent the narrow end of the ice cube, as shown, for example, in FIG. 14. In the Freeze HD Touch Off state, the heater 54 is off and the water valve 32 is closed. The controller 30 drives the motor 42 to rotate the ejector arm 44 in the direction the ejector arm 44 moves during harvest by the number of steps required to complete one quarter of a full rotation from the home position, in the illustrated embodiment one thousand eighty steps. At some time during the rotation of the ejector arm 44 in the harvest direction, the end of the front face 118 of an ejector member 52 will engage the top surface 132 of its associated ice cube 130 and the ejector arm 44 will stall. After the ejector arm 44 stalls, additional energizations of the windings of the stepper motor 42 will not induce rotation of the ejector arm 44. After the controller 30 has energized the windings in the appropriate patterns the appropriate number of times to drive an unobstructed ejector arm 44 one quarter rotation in the harvest or forward direction, the controller 30 then energizes the windings of the stepper motor 42 in the opposite sequence to reverse the direction of the motor 42 and the ejector arm 44 to move the ejector arm 44 back to the home position. The controller 30 records the number of steps taken to get back to the home position and subtracts it from the number of steps that were taken in the harvest direction. The difference provides an indication of angular position where the ejector arm 44 stalled on the ice 130. Since the configuration and relative position of ejector arm 44 and tray 20 are known, the angular position of the ejector arm 44 provides an indication of the height of the ice cubes 130 formed in the tray 20.

In the illustrated embodiment, the controller 30 then assumes the Freeze Wide Direction Touch Off ("Freeze WD Touch Off") state to check the height of the ice 130 on the opposite side of the tray 20 to perform a wide side ice level determination step 1636. In the Freeze WD Touch Off state, the water is frozen and the height of the ice 130 is determined by stalling the ejector arm 44 as a result of the rear face 120 of the ejector members 52 touching the top surface 132 of the ice cube 130 adjacent the wide side of the compartments 66. This state is similar to the Freeze HD Touch Off state except that the motor 42 is initially rotated in the direction opposite the harvest direction (i.e. in the direction of arrow 116 in FIG. 13) to stall the ejector member 52 on the surface 132 of the ice cube 130 adjacent the wide end of the ice cube 130. The controller 30 drives the motor 42 to rotate the ejector arm 44 in the direction opposite the direction the ejector arm 44 moves during harvest (i.e. in the direction of arrow 116 in FIG. 13) by the number of steps required to complete one quarter of a full rotation from the home position, in the illustrated embodiment one thousand eighty steps. At some time during the rotation of the ejector arm 44 in the reverse direction (i.e. in the direction of arrow 116 in FIG. 13), the end of the rear face 120 of an ejector member 52 will engage the top surface 132 of its associated ice cube 130 adjacent the wide end of the ice cube 130. Upon engagement, the ejector arm 44 will stall so that the additional energizations of the windings of the stepper motor 42 will not induce rotation of the ejector arm 44. After the controller 30 has energized the windings in the appropriate patterns the appropriate number of times to drive an unobstructed ejector arm 44 one quarter rotation in the reverse direction (i.e. in the direction of arrow 116 in FIG. 13), the controller 30 then energizes the windings of the stepper motor 42 in the opposite sequence to reverse the direction of the motor 42 and drive the ejector arm 44 to move in the harvest or forward direction (i.e. in the direction of arrow 56) back to the home position. The controller 30 records and stores in memory 40 the number of steps taken to get back home and subtracts it from the number of steps that were taken in the reverse direction. The difference provides an indication of angular position where the ejector arm 44 stalled on the ice 130. Since the configuration and relative position of ejector arm 44 and tray 20 are known, the angular position of the ejector arm 44 provides an indication of the height of the ice cubes 130 formed in the tray 20.

As described above, once the water is frozen, the ejector arm 52 is used to measure the height of the surface 132 of the ice 130. The ice 130 is measured by rotating the ejector arm 44 in both directions and determining where the arm 44 stalled on the ice in each direction. In the illustrated embodiment, the controller 30 compares the touch off value on the inside of the cubes and the outside of the cubes 1638. The controller 30 sets the inside touch off value as the ice height 1640 if it is smaller than the outside touch off value. Otherwise, the controller 30 sets the outside touch off value as the ice height 1642. The controller 30 utilizes the smaller touch off value to determine whether the Fill finish % needs to be adjusted in an ice level comparison step 1644. The smaller touch off value is utilized because the smaller the touch off value the bigger the cube 130. If water is detected during the fill, which is evident by the Water Detect Point being non-zero, then the Fill finish % will be modified based on the touch off data in the fill time adjustment step 1606. If the touch off data is equal to the Desired Touch Off then the Fill finish % is not adjusted. If the touch off data is less than Desired Touch Off (the tray is overfilled) then the Fill finish % is decreased by five percent in a fill time reduction step 1632. If the touch off is greater than Desired Touch Off, the Fill finish % is increased by five percent in a fill time increase step 1630.

The Desired Touch Off value is stored in memory 40 and used by the controller 30 to determine whether or not to increase or decrease the Fill Time. In the illustrated embodiment, the default value for the Desired Touch Off is six hundred steps from Home Position. Thus, if the lower of the stored values of the HD Touch Off and WD touch off value is greater than six hundred, the controller 30 adjusts the Fill Time to achieve a smaller touch off value closer to six hundred steps by increasing the Fill finish % by 5 percent in a fill time increase step 1630. If the lower of the stored values of the HD Touch Off and WD touch off value are less than six hundred, then the controller 30 will adjust the Fill finish % by decreasing it by 5 percent in a fill time reduction step 1632. Following the fill adjustment step 1606, the ice maker assembly 10 ejects the ice cubes 130 in an ejection step 1646 as described above and returns to determining if the tray is cold enough 1608 to begin the filling step 1602.

The illustrated controller 30 operates in a plurality of states in which it controls the motor 42, heater 54 and solenoid fill valve 32. The controller 30 has been described as assuming the Harvest Ready, Harvest Thaw, Harvest Finish, Harvest Error, Harvest Error Home, Harvest Finish, Fill Tray Cool, Fill Arm Position, Fill Valve Cold, Fill Valve Open, and Freeze Stir states. Those skilled in the art will recognize that the controller 30 can assume more or less states depending on the functionality desired in the ice maker assembly 10. The disclosed invention can be implemented in ice maker assemblies that do not use the ejector members 52 to displace water during filling or that do not stir the water during cooling, within the scope of the disclosure.

While not illustrated, during power up, the icemaker assembly 10 tries to return to the same conditions it was at when it powered down. The algorithm Current State is read from the EEPROM 40 at power up. When powering down occurs in most states, the state is recorded and stored in the EEPROM 40 and on power up the controller 30 simply returns to the state in which it was in during power down. Two exceptions are when there is a power down in the Freeze Stir, Freeze Stir Home states. When a power down occurs in the Freeze Stir, Freeze Stir Home states, the controller 30 enters the Freeze Home state on power up, to avoid the ejector arm 44 getting stuck during stirring.

Another exception is when a power down occurs during the Fill Valve Open state which will go to the Fill Valve Cold states. If there is a power down in the Fill Valve Cold or Fill Valve Open states, the valve on time is written to the EEPROM 40 so the controller 30 does not overfill the tray 20 when returning on power up.

All temperature information is reported to the controller 30 as A/D data and is stored internally in memory 40. Illustratively, all temperatures are A/D values that correspond to the desired temperature. Alternatively, temperatures could be offsets from a detected actual freezing point temperature. Among the temperatures and times recorded and stored are the Fill temp, Fill temp/time, the Stop Stir temp, Stop Stir time, Freeze temp, Freeze time and the Water Present temp delta.

The Fill temp is the temperature at which the tray should be before opening the water valve 32 to fill the tray 20 and the Fill temp/time is time at which the tray 20 should be at the Fill temp before opening the water valve 32 so that there will be a detectable temperature change when water contacts the temperature sensor 160 during filling. The Fill temp and Fill temp/time are read from the EEPROM 40 on power-up. If a value cannot be read from the EEPROM 40, the default value for Fill temp is set to approximately −3° C., the default value for Fill temp/time is five seconds. Both values are written to EEPROM 40 when a Control Temperature/Timing Set message is received.

Figure 22:
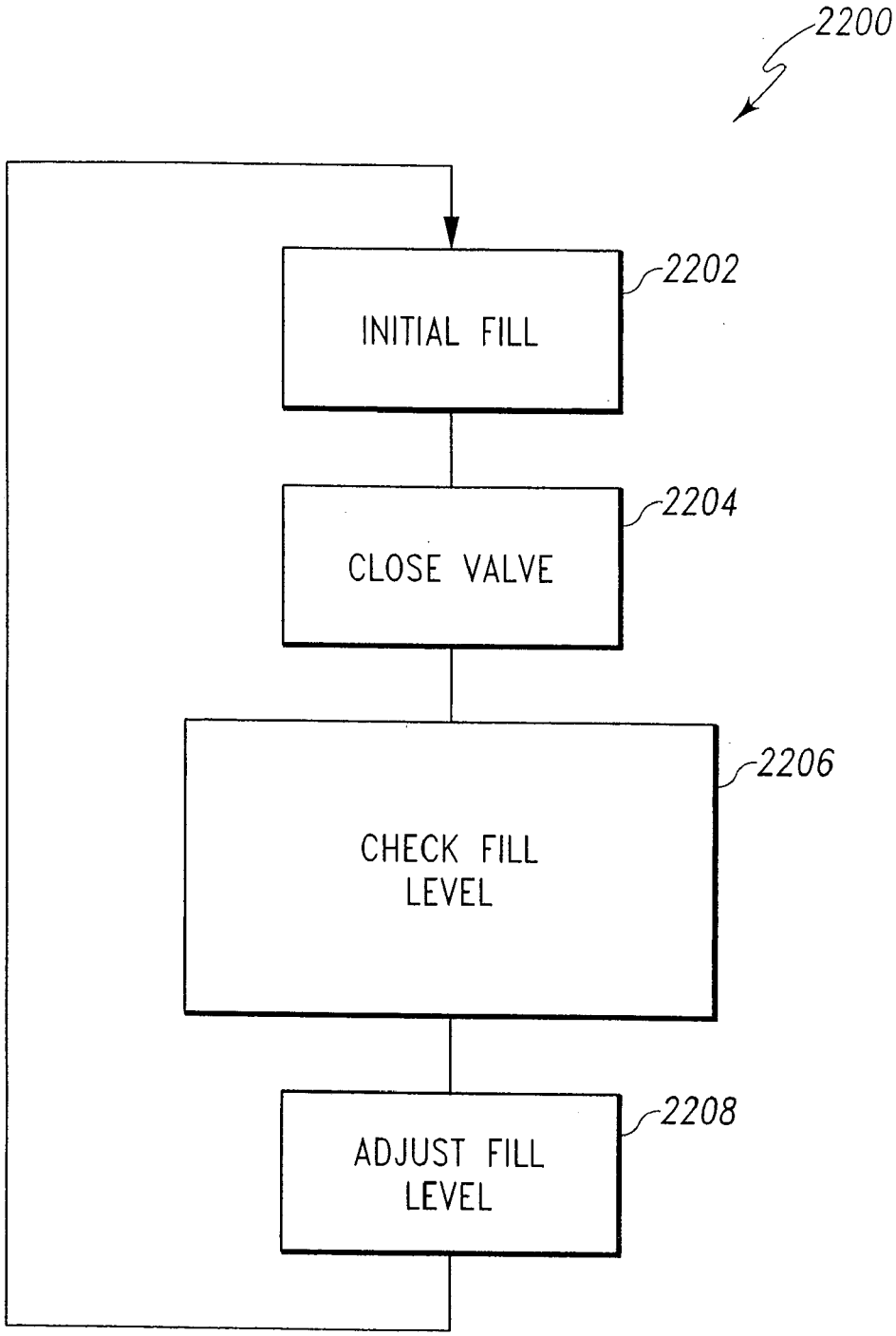
FIG. 22 is a flow diagram of a second method of adaptively filling an ice tray wherein the fill level of water in the tray is determined and the fill time is adjusted accordingly.
Figure 23:
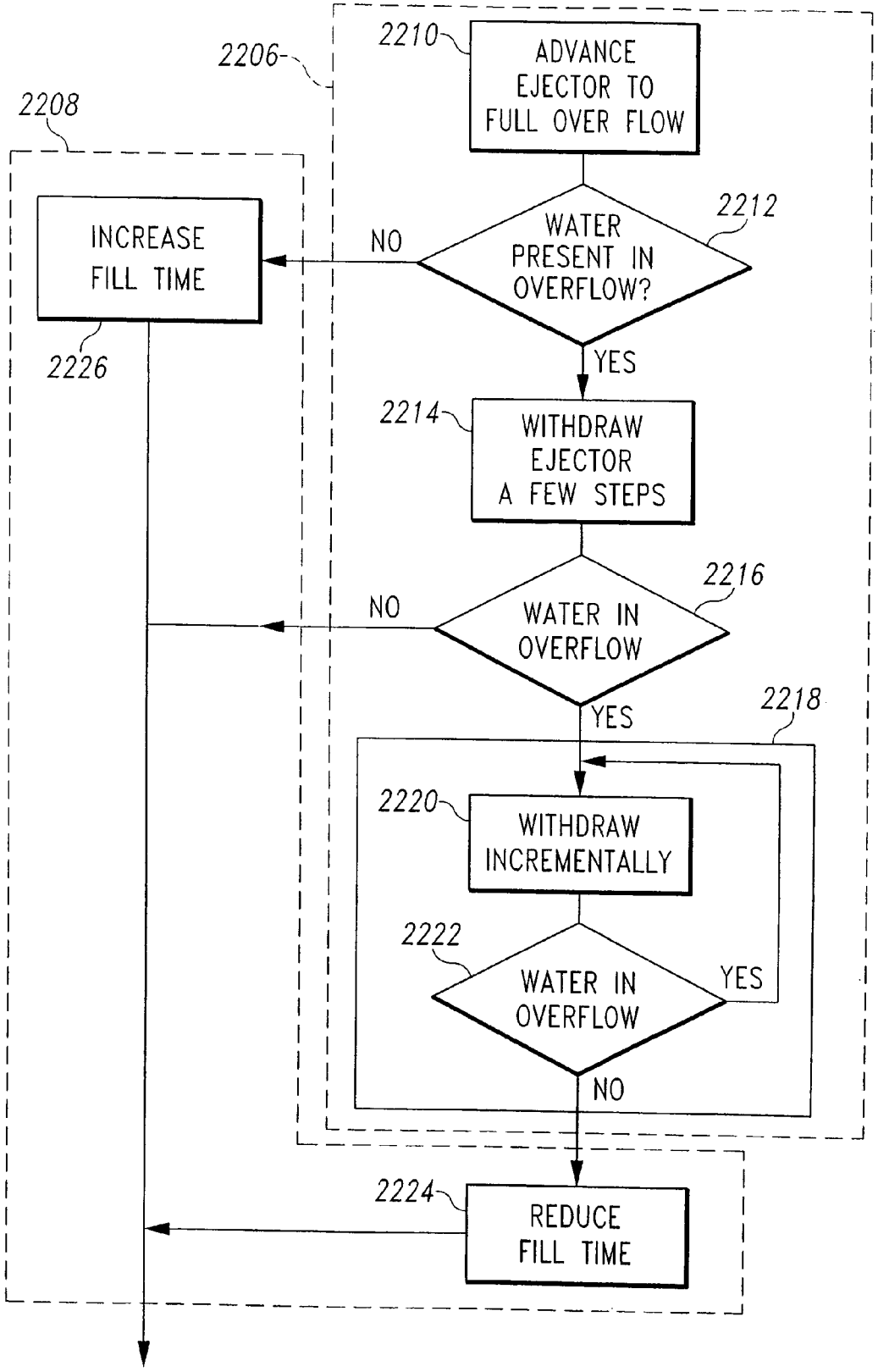
FIG. 23 is a flow diagram of a method of determining the fill level utilizing the ejector members to displace water to induce the water to overflow into an overflow compartment and adjusting the fill time that may be used with the method of FIG. 22.

In the disclosed second embodiment of adaptively filling an ice tray 2200, the level to which the ice tray 20 has been filled is detected by displacing water with the ejector members 52 until the water rises to a level where it is detected by an overfill sensor 117 in the overflow trough 114, as shown for example, in FIGS. 22 and 23. In the illustrated embodiment, the overflow trough 114 is formed in the first end wall 76 of the front compartment **66*f* of the ice tray 20. Water flows into the overflow trough 114 when each compartment 66 is filled to the desired level and the ejector members 52 are in a desired position to displace water in the compartments 66. The overflow sensor 117 may be a conductor pin insulated from the tray 20 and positioned to sense presence of water in the overflow trough 114**.

In the second embodiment of the disclosed ice maker assembly 10 the stepper motor 42 is utilized to precisely fill the compartments 66 of the ice tray 20. Because a stepper motors can advance and reverse with good resolution of its output shaft's angular position without using an encoder, such a motor can be used to precisely fill the ice tray 20, regardless of temperature in the freezer, auto defrost time, local water pressure and/or hardness, age of valve, etc. It is also within the scope of the disclosure to use a stepper motor 42 with an encoder 150 or another reversible motor with an encoder 150 to implement the adaptive filling process of the second embodiment. In the second embodiment of the ice maker assembly 10, the ejector members 52 and the overflow sensor 117 are utilized to detect available displaced/un-displaced volumes in the compartmentalized tray 20. When the disclosed ejector members 52 are disposed in the ice forming spaces 104 of the compartments 66 of the tray 20, they act to displace water present in the compartment. By alternatively operating the valve 32 and rotating the ejector arm 44 farther into and out of the ice forming compartments 104, the ice tray 20 can be precisely filled to a desired level.

In the second embodiment, the tray is initially filled for an anticipated accurate Fill Time in an initial fill step 2202. The Fill Time used in the initial fill step 2202 could be determined as described in the first embodiment above or could be a calibrated Fill time set at the factory. After the Fill Time has expired the water valve 32 is closed by the controller 30 in a close valve step 2204. Following the close valve step 2204, the controller 30 determines the fill level of the tray 20 in a check fill level step 2206.

In the illustrated embodiment, the check fill level step 2206 is accomplished by the controller 30 driving the motor 42 to position the ejector members 52 in the compartments 66 to displace sufficient water to cause overflow of the water into the overflow trough 114 at the front of the tray 20 if the tray 20 is properly filled in an initial ejector advancement step 2210. It is then determined if water is present in the overflow 2212. If water is present in the overflow trough 114 after so positioning the ejector members 52, the overflow sensor 117 senses the presence of water in the overflow trough 114, then the controller drives the motor 42 to rotate the ejector arm 44 a few steps in the reverse direction in a partial withdrawal step 2214. After this initial rotation in the reverse direction it is again determined if water is present in the overflow trough 2216. If water is no longer detected in the overflow trough 114, then the tray is properly filled and the Fill time is not adjusted for the next cycle. If water is still detected in the overflow trough following the rotation in the reverse direction the tray 20 was overfilled during the current filling cycle. If it is determined that the tray 20 has been overfilled, the controller 30 drives the motor 42 to rotate the ejector arm 44 incrementally in the reverse direction until water is no longer detected in the overflow trough 114 in a fill level reduction determination step 2218. In the fill level reduction determination step 2218, the ejector arm is repeatedly incrementally withdrawn 2220 from the compartment 66 and the presence of water in the overflow is repeatedly sensed 2222. The Fill time is reduced during the next fill cycle based on the position of the ejector arm 44 when water is no longer detected in the overflow trough 114 in the reduce Fill time step 2224.

If water is not detected in the overflow trough 114 after the initial ejector advancement step 2210, then the tray 20 was under-filled during the most recent filling cycle. In an under-fill situation, the controller 30 increases the Fill Time 2226. The increasing the Fill Time step 2226 can be accomplished either by repeatedly opening the valve 32 for small periods until the presence of water is detected in the overflow trough 114 and/or by adjusting the Fill Time accordingly for the next filling cycle. It is also within the scope of the disclosure to repeat the advancing, sensing and adjusting steps until the desired fill level is achieved.

While two specific embodiments of methods for detecting the level to which the ice tray 20 has been filled have been disclosed, it is within the scope of the disclosure for the fill level of the tray 20 to be detected in other manners. For instance, it is within the scope of the disclosure to use an optical of sonic sensor to detect the presence of water.

While the disclosed invention may be implemented using a conventional ice tray 20, it is described as being implemented using a weirless tray which fills on an overflow principal. Absence of a weir gives several advantages that are more fully disclosed in the incorporated U.S. patent application Ser. No. 10/895,792 filed Jul. 21, 2004, entitled Method and Device for Eliminating Connecting Webs Between Ice Cubes.

Although specific embodiments of the invention have been described herein, other embodiments may be perceived by those skilled in the art without departing from the scope of the invention as defined by the following claims.

What is claimed is:

1. A method of producing ice, comprising the steps of:

opening a valve for a first period of time during a first ice making cycle so that water advances from a fluid source into at least one ice forming compartment of an ice tray through said valve;

determining with a member used to eject ice from said at least one ice forming compartment of said ice tray whether a level of water in said at least one ice forming compartment is below a threshold value during said first ice making cycle and generating a control signal in response thereto;

reducing temperature of water within said ice tray during said first ice making cycle so as to cause said water located within said at least one ice forming compartment to become a first ice cube having a first size;

opening said valve for a second period of time during a second ice making cycle in response to generation of said control signal so that water advances from a fluid source into said least one ice forming compartment of said ice tray through said valve during said second ice making cycle, wherein said second period of time is greater than said first period of time; and reducing temperature of water within said ice tray during said second ice making cycle so as to cause said water located within said at least one ice forming compartment to become a second ice cube having a second size that is greater than said first size.

2. The method of claim 1, wherein the member is utilized to determine the level of the water in said at least one ice forming compartment after the water in said at least one ice forming compartment has frozen to form an ice cube and prior to said ice cube being ejected from said at least one ice forming compartment.

3. The method of claim 2, wherein the member is stalled on a surface of said ice cube and the level of the water is determined by comparing the actual position of member when it is stalled with a desired position for the member to stall when the level of water in said at least one ice forming compartment is at a desired level.

4. The method of claim 3, wherein the member is stalled on a first location on said surface of said ice cube and on a second location on said surface of said ice cube to determine the level of water in said at least one ice forming compartment.

5. The method of claim 3, wherein the comparison of the actual position of member when it is stalled with a desired position for the member to stall when the level of water in said at least one ice forming compartment is at a desired level is utilized to generate the control signal.

6. The method of claim 1, wherein the member is submerged in the water in said at least one compartment to displace water in said at least one compartment to raise the level of the water in the said at least one compartment toward a sensor to determine the level of the water in the said at least one compartment.

7. The method of claim 6 wherein the level of the water is determined by comparing the actual position of member when it displaces sufficient water to activate the sensor with a desired position for the member to displace sufficient water to activate the sensor when the level of water in said at least one ice forming compartment is at a desired level.

8. The method of claim 7 wherein the comparison of the actual position of member when it displaces sufficient water to activate the sensor with the desired position for the member to displace sufficient water to activate the sensor when the level of water in said at least one ice forming compartment is at a desired level is utilized to generate the control signal.

9. An icemaker assembly, comprising:

an ice tray having at least one ice forming compartment;

a water line configured to advance water from a water source to said ice tray;

a valve operable to selectively block advancement of water through said water line while an actuation signal is generated;

an elector configured to eject ice members formed in said ice forming compartment;

a control system operable to generate said actuation signal for a water advancement period and operable to control said ejector; and a water level detection system that uses said ejector for determining if a level of water in said at least one ice forming compartment is below a threshold value and generating a control signal in response thereto, wherein said control system is further operable to alter a magnitude of said water advancement period in response to generation of said control signal.

10. The ice maker assembly of claim 9, wherein said control system receives data regarding the position of said ejector and said ejector is utilized to determine the level of the water in said at least one ice forming compartment after the water in said at least one ice forming compartment has frozen to form an ice member and prior to said ice member being ejected from said at least one ice forming compartment.

11. The icemaker assembly of claim 10, wherein the control system drives the ejector to be stalled on a surface of said ice member and the level of the water is determined by comparing the actual position of ejector when it is stalled with a desired position for the ejector to stall when the level of water in said at least one ice forming compartment is at a desired level.

12. The icemaker assembly of claim 11, wherein the ejector is stalled on a first location on said surface of said ice member and on a second location on said surface of said ice member to determine the level of water in said at least one ice forming compartment.

13. The icemaker assembly of claim 11, wherein the control system compares the actual position of ejector when it is stalled with a desired position for the ejector to stall when the level of water in said at least one ice forming compartment is at a desired level to generate the control signal.

* * * * *